US010006737B1

(12) United States Patent
McDaid

(10) Patent No.: US 10,006,737 B1
(45) Date of Patent: Jun. 26, 2018

(54) PROJECTILE LAUNCHER TRIGGER

(71) Applicant: Sherrill, Inc., Greensboro, NC (US)

(72) Inventor: Cornelius McDaid, Randolph, MA (US)

(73) Assignee: Sherrill, Inc., Greensboro, NC (US)

( * ) Notice: Subject to any disclaimer, the term of this patent is extended or adjusted under 35 U.S.C. 154(b) by 0 days. days.

(21) Appl. No.: 15/812,519

(22) Filed: Nov. 14, 2017

(51) Int. Cl.

| | |
|---|---|
| ***F41B 3/02*** | (2006.01) |
| ***F41B 5/18*** | (2006.01) |
| ***F41B 3/00*** | (2006.01) |
| ***F41B 5/14*** | (2006.01) |

(52) U.S. Cl.
CPC ..... *F41B 3/005* (2013.01); *F41B 5/1469* (2013.01)

(58) Field of Classification Search
CPC ..... F41B 3/005; F41B 5/1469
See application file for complete search history.

(56) References Cited

U.S. PATENT DOCUMENTS 3,895,621 A * 7/1975 Kellogg ..... F41B 5/1469 124/24.1
5,551,412 A 9/1996 Warnke
5,887,577 A 3/1999 Sherrill
6,161,532 A * 12/2000 Goff ..... F41B 5/1469 124/35.2
6,286,496 B1 9/2001 Bednar
6,968,836 B1 * 11/2005 Kees ..... F41B 5/1469 124/35.2
8,720,013 B2 5/2014 Chen
8,720,014 B2 5/2014 Chen
9,395,139 B2 7/2016 Pena

OTHER PUBLICATIONS

Big Shot Release Trigger, Sep. 29, 2015.
BIGshot Snap, Sherrill, Inc., Mar. 4, 1999.

* cited by examiner

*Primary Examiner* — John Ricci
(74) *Attorney, Agent, or Firm* — Altman & Martin; Steven K Martin

(57) ABSTRACT

A trigger assembly for a projectile launcher with a hinged cuff that attaches to the launcher pole using a quick-release mechanism. A trigger mechanism has a elongated finger, one end of which is bent 90° to a stem that is pivotally mounted. One end of a release bar is pivotally mounted to the stem bend such that pulling the trigger pulls the release bar backwardly. A pivotally-mounted catch has an arm that forms a notch for the launcher pouch loop. The catch is held in the capture position by the release arm holding against a ledge on the catch. Pulling the trigger causes the release arm to release the catch. A pivotally-mounted safety latch has a finger with a notch that hooks onto a pin in the trigger to prevent pulling the trigger. A latch release lever enables the user to disengage the latch from the pin.

9 Claims, 28 Drawing Sheets

PROJECTILE LAUNCHER TRIGGER

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to projectile launchers, more particularly, to a trigger release mechanism to retrofit a manual launcher.

2. Description of the Related Art

Projectile launcher are well-known. A typical launcher is described in U.S. Pat. No. 5,887,577, entitled Apparatus for Propelling a Projectile. In summary, the apparatus has a shaft and head at one end of the shaft. The head has a pair of elongated arms that extend paraxially away from the shaft to form a generally Y-shaped configuration. The arms curve back to the shaft until the ends of the arms are generally parallel to the shaft. One end of each of a pair of elastic tubes slide onto the arm ends. The other end of each of the elastic tubes attach to a pouch, forming a sling assembly. A loop is attached to the pouch. The shaft slides onto the top end of an elongated pole.

In normal operation, the user places the end of the pole on the ground and places a weight into the pouch. The user pulls back on the loop to apply tension to the elastic tubes. The user then releases the loop to cause the elastic tubes to propel the weight upwardly.

The normal operation of the launcher has several drawbacks. Launching accuracy and distance is inconsistent due to randomized pull of the projectile pouch. A lot of energy is used to maintain and support the pouch in the stationary firing position prior to launch. As a result, fatigue often leads to poor shot accuracy and/or distance. Repeated inaccurate firings can lead to premature wear on the pouch. From a safety standpoint, accidentally releasing the tensioned tubing can cause harm to oneself or property.

BRIEF SUMMARY OF THE INVENTION

The present invention is a trigger assembly for a projectile launcher that is attached to the launcher pole by a cylindrical cuff. The cuff is composed of a trigger half-cylinder and a pole half-cylinder that are attached at one edge by a hinge.

The inner surfaces are optionally textured to produce friction against the pole, either by molding or roughening the inner surfaces or attaching separate rubber inserts.

An attachment mechanism secures the cuff around the pole. In the present design, the attachment mechanism is a quick-release mechanism that employs a cammed paddle pivoting on a lever rod. One end of rod is pivotally attached to the free edge of the trigger half-cylinder. The other end is attached to the pivot edge of the paddle. The length of the rod can be non-adjustable or adjustable.

Adjacent to the free edge of the pole half-cylinder is an elongated, concave bearing surface. At the bearing end of the paddle is an elongated, convex bearing surface. In cross-section, the bearing surface is eccentric, being smaller in radius where it initially contacts the concave bearing surface and increasing in radius around the circumference.

To attach the cuff to the pole, the half-cylinders pivoted apart, placed around the pole, and pivoted until the free edges are adjacent to each other. The paddle is pivoted toward the pole half-cylinder until the paddle bearing surface is in contact with the pole half-cylinder bearing surface. The paddle is pivoted toward the pole half-cylinder outer surface until it rests against the outer surface. As the paddle pivots inwardly, the radius of the paddle bearing surface in contact with the pole half-cylinder bearing surface increases, pushing the half-cylinder free edges together.

The trigger mechanism is in a housing on the outside surface of the trigger half-cylinder.

The trigger is an elongated, curved, finger. One end of the trigger bend 90° to a stem. The trigger pivots perpendicularly to the system axis in a slot in the housing on a pin.

A release bar extends paraxially in the housing. One end is pivotally attached to the trigger stem, so that, when the trigger is pulled inwardly, the trigger pulls the release bar rearwardly. A coil spring biases the release bar toward the front.

The launcher loop is held in the trigger assembly by the catch, a generally wedge-shaped component with an arm extending from a pivot. The pivot rotates in a radial slot in the front of the housing on a pin. The arm extends from the pivot. In the capture position, the rear edge of the arm slopes outwardly and rearwardly from the pivot and forms a notch with a hollow in the outer surface of the housing that retains the launcher loop.

At the junction between the pivot and arm is a ledge that faces outwardly. In the capture position, the ledge is generally parallel to the system axis. The ledge and release bar operate together to retain the catch in the capture position. When in the capture position, the trigger spring pushes the release bar forwardly and outwardly of the ledge so that the front of the release bar overhangs the ledge.

An optional safety latch mechanism prevents inadvertent operation of the trigger mechanism. A latch has a pivot, a hook finger, and a release lever. The latch pivots outside of the trigger at the pivot. A torsion spring biases the latch in the latched position. The hook finger has a forward-facing hook notch that fits around a latch pin in the trigger. In the latched position, the pin is within the notch, preventing the trigger from being pulled. The latch release lever enables the user to disengage the latch by pushing it outwardly to the unlatched position.

To use the trigger mechanism, it is first put in the capture position where the catch is pivoted fully backward to form the notch with the hollow. The trigger is pivoted fully outwardly so that the release bar is biased over the ledge. The safety mechanism is engaged in the latched position. The launcher loop is pulled back and hooked around the catch. The operator pushes the latch release lever outwardly to the unlatched position and then pulls the trigger. As the trigger pivots inwardly, it pulls the release bar from the catch ledge and the forward force of the loop pulls the catch forwardly, thereby releasing the loop to fly forwardly.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present invention is a trigger assembly for use with a projectile launcher, such as that taught in U.S. Pat. No. 5,887,577, described above.

Figure 3:
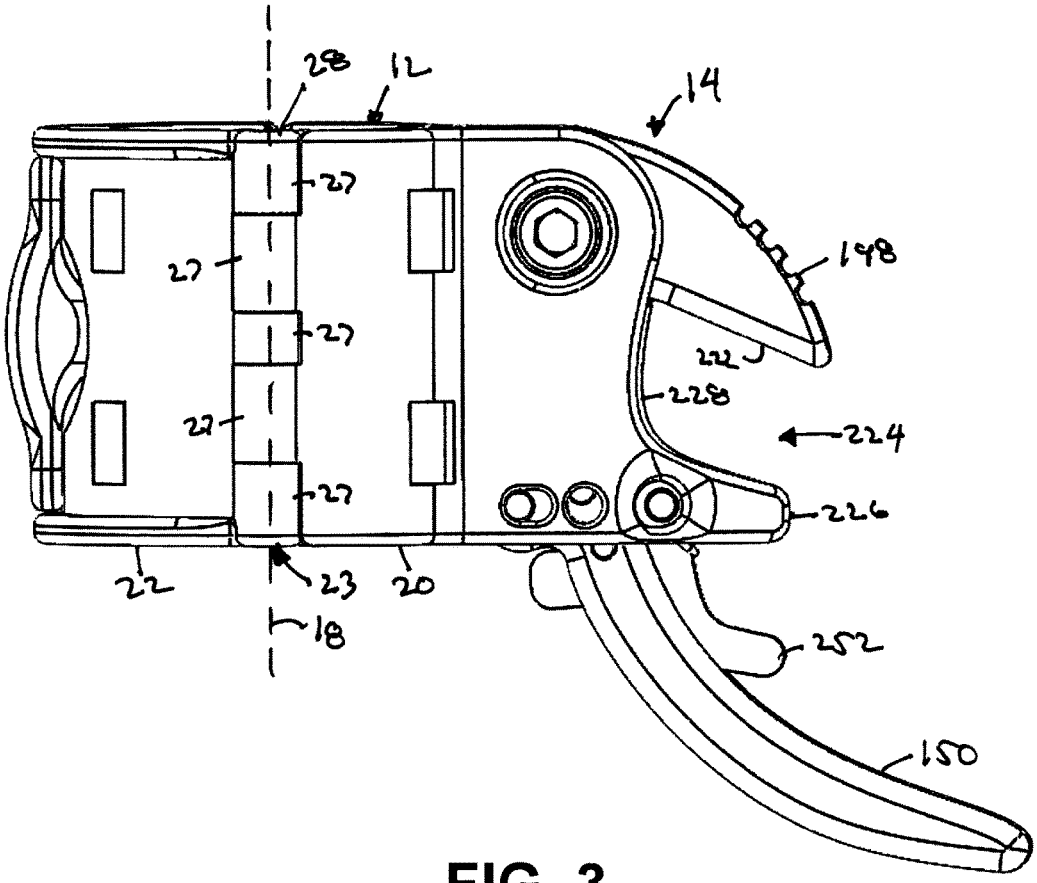
FIG. 3 is a hinge side view of the trigger assembly of the present invention.
Figure 4:
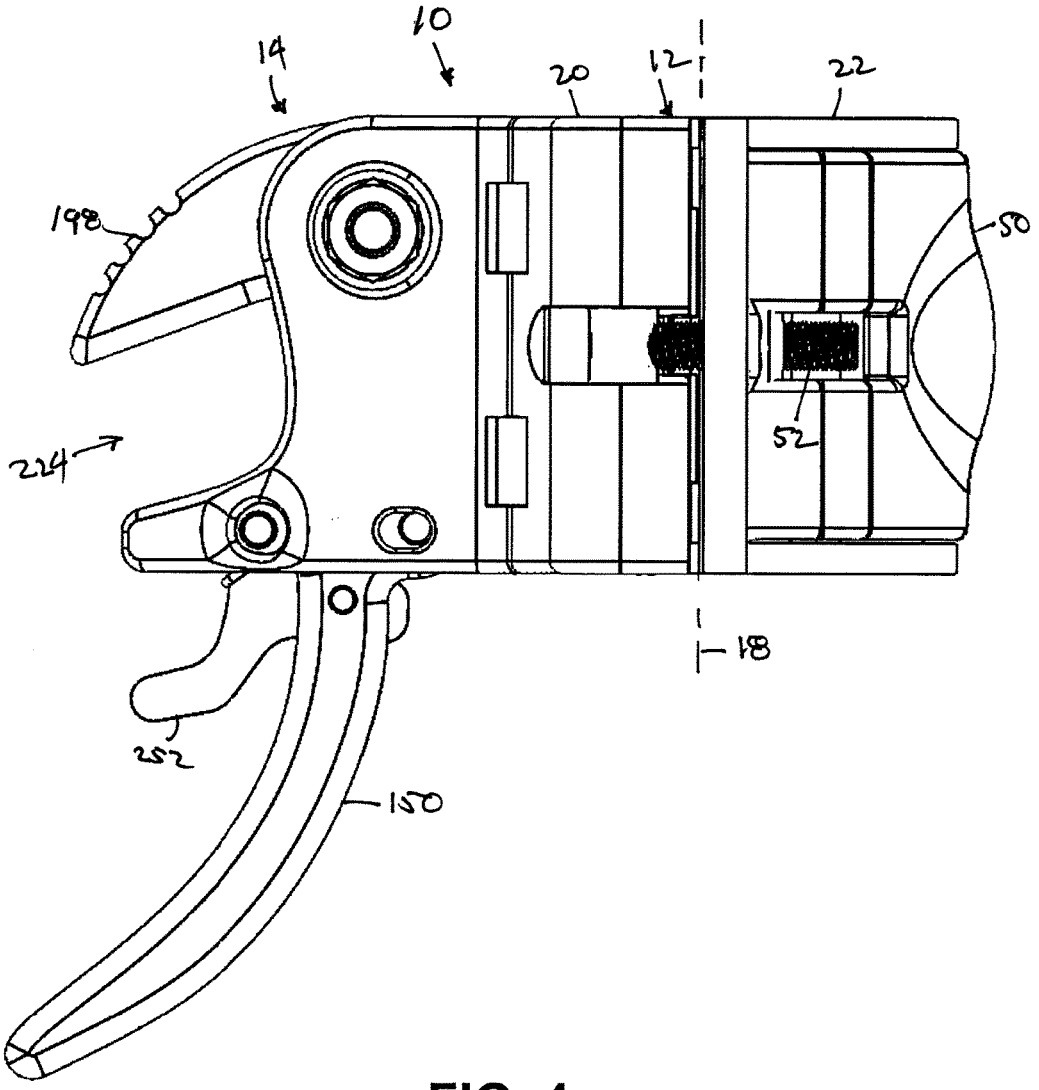
FIG. 4 is a lever side view of the trigger assembly of the present invention.

In the present specification, the front of the trigger assembly 10 is toward the head 3 of the launcher 1, up in FIG. 3, and the rear or back is away from the head 3 of the launcher 1, down in FIG. 3. The system axis 18 is the axis of the cylindrical cuff as shown in FIG. 3. The inside or inner direction is toward the system axis 18 and outside or outer direction is away from the system axis 18.

Figure 5:
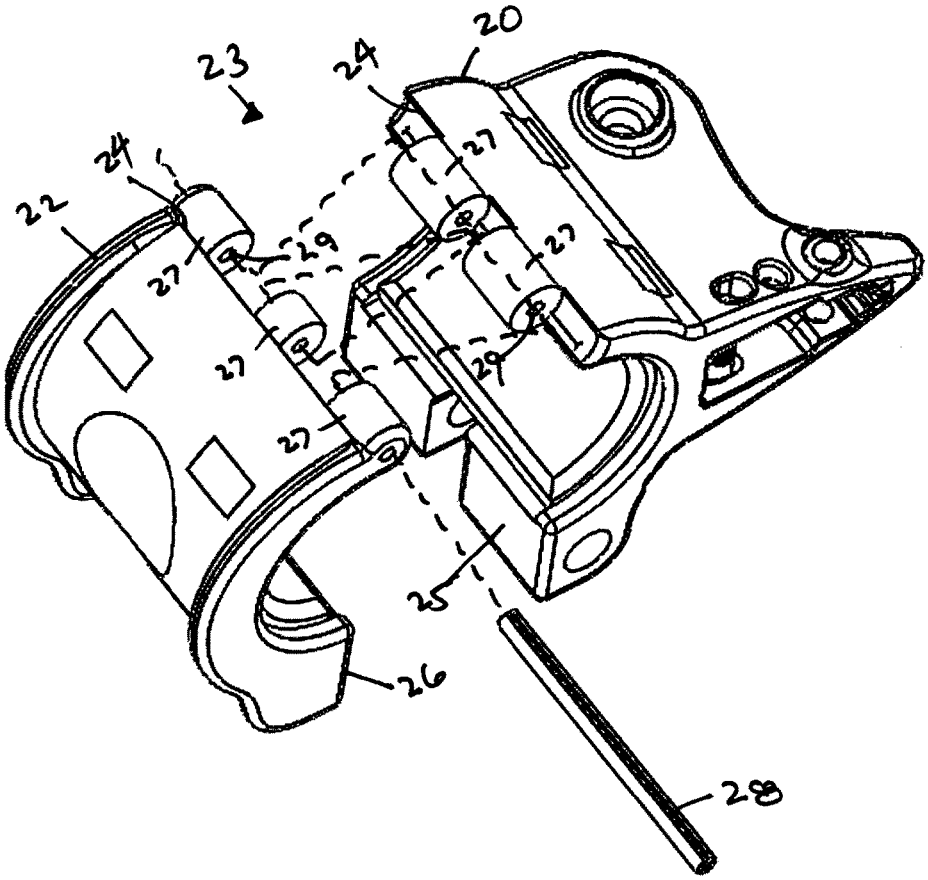
FIG. 5 is an exploded view of the hinge.

The trigger assembly 10 of the present invention is attached to the launcher pole 2 by a cylindrical cuff 12 that surrounds the pole 2. The cuff 12 is composed of two half-cylinders, the trigger half-cylinder 20 and the pole half-cylinder 22, shown in FIG. 5, that are attached at one edge 24 by a hinge 23 that is parallel to the system axis 18. The half-cylinders 20, 22 pivot on the hinge 23 until the free edges 25, 26 meet to form the cylindrical cuff 12.

The present invention contemplates any type of structure for the hinge 23 that is robust enough. One example is a living hinge, where the cuff 12 is made as a single component with the two half-cylinders 20, 22 attached by a thin, bendable strip that operates as the hinge 23. In the design shown in the figures, the hinge 23 is composed of alternating and interlocking knuckles 27 with a pin 28 passing through aligned holes 29 in the knuckles 27.

The inner surface 32 of each half-cylinder 20, 22 is optionally textured to produce friction against the pole 2 to keep the trigger assembly 10 at the desired location on the pole 2. The present invention contemplates several different methods of texturing the half-cylinder inner surfaces 32.

In one method, the inner surface 32 is textured by molding the half-cylinders 20, 22 with a roughened inner surface 32. In another, the inner surfaces 32 are roughened after forming the half-cylinder 20, 22.

Figure 6:
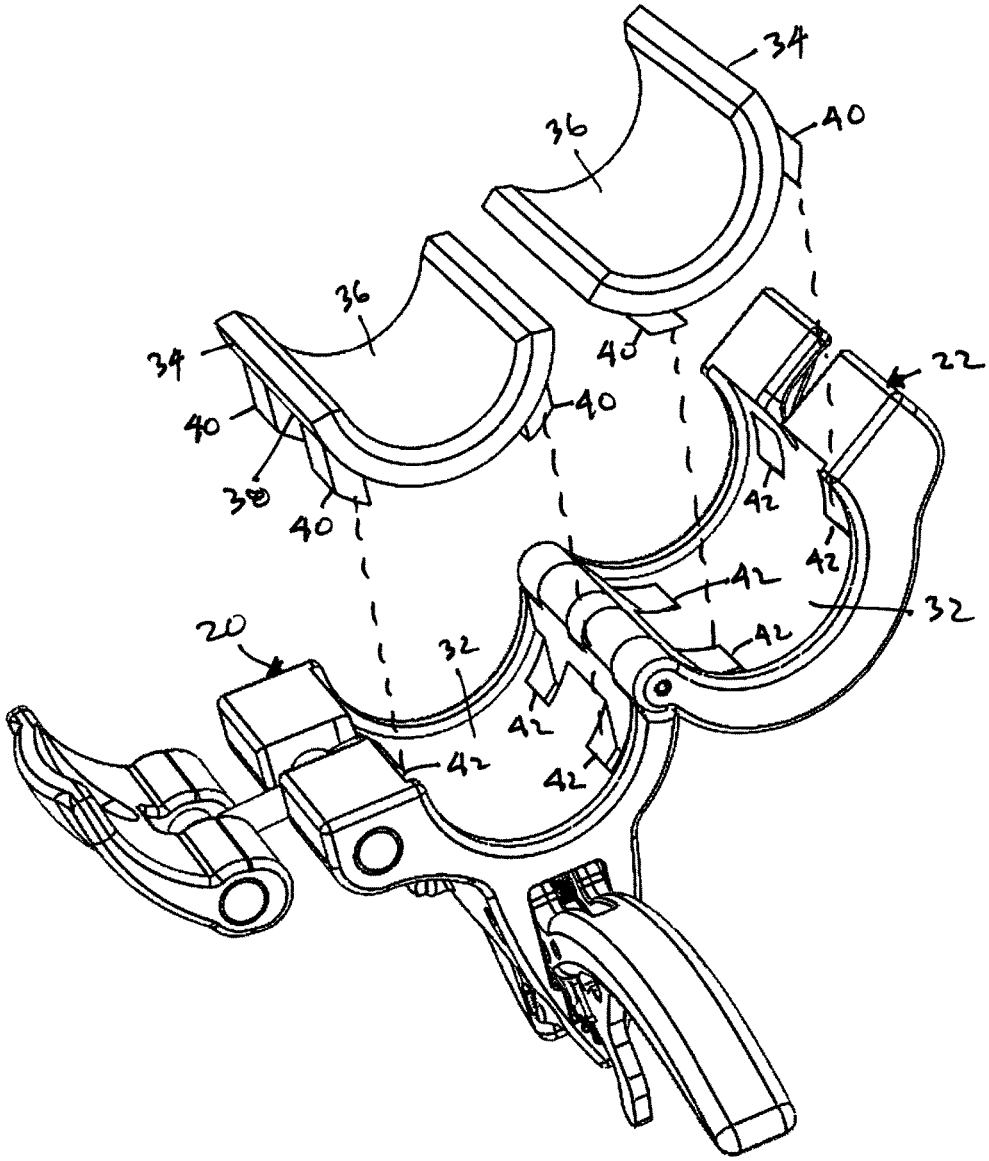
FIG. 6 is a perspective view of the open cuff with inserts.

In another method, shown in FIG. 6, separate inserts 34 are attached to each of the half-cylinder inner surfaces 32. The inserts 34 are composed of rubber or other friction-producing material. The inner surface 36 of the inserts 34 can be smooth or textured. The outer surface 38 of the inserts 34 conforms to the half-cylinder inner surface 30.

The insert 34 also provides sizing for poles 4 of different diameters. For a given diameter cuff 12, the radial thickness of the insert 34 determines the pole diameter onto which the trigger assembly 10 will properly fit.

Any manner of attaching the insert 34 is contemplated, including adhesives. In the present design, the outer surface 38 of the insert 34 has fingers 40 that fit into apertures 42 in the half-cylinder inner surface 32 to retain the insert 34 properly. Optionally, the fingers 40/apertures 42 can be designed so that the fingers 40 snap into the apertures 42 for better retention.

The cuff 12 is secured around the pole 2 by an attachment mechanism 46. In the present configuration, the attachment mechanism 46 is a quick-release mechanism that employs a cammed lever 48. The lever 48 has a paddle 50 mounted to pivot on a lever rod 52. The cuff end 54 of the rod 52 is attached at the free edge 25 of the trigger half-cylinder 20 so that the rod 52 pivots paraxially. The paddle end 56 of the rod 52 is attached to the pivot edge 68 of the paddle 50 so that the paddle 50 pivots on the rod end 56.

Figure 8:
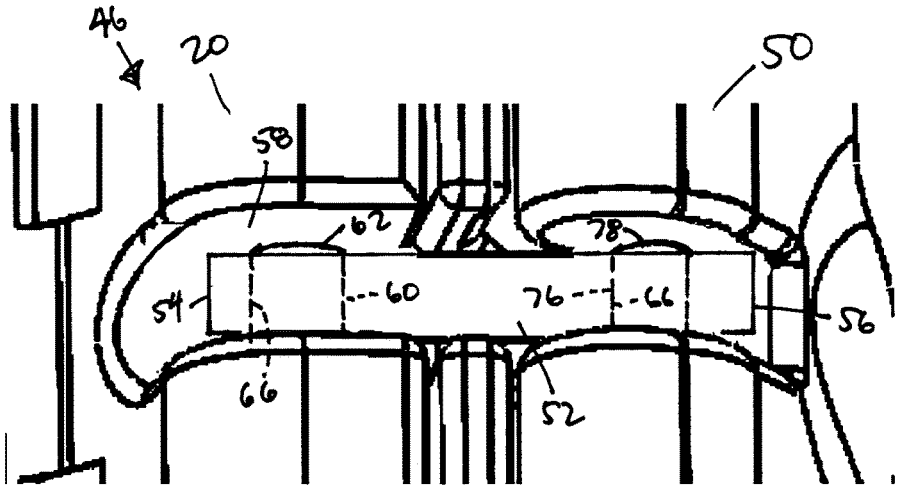
FIG. 8 is a perspective view of a non-adjustable lever rod attachment.

In a non-adjustable configuration of the pivoting attachment, shown in FIG. 8, the rod cuff end 54 fits in a radial slot 58 in the trigger half-cylinder free edge 25. A pin 60 extends through aligned, paraxial cuff holes 62 in the free edge 25 and a hole 64 in the rod cuff end 54. The pin 60 is press-fit into the cuff holes 62 for retention and the rod 52 pivots on the pin 60.

Figure 9:
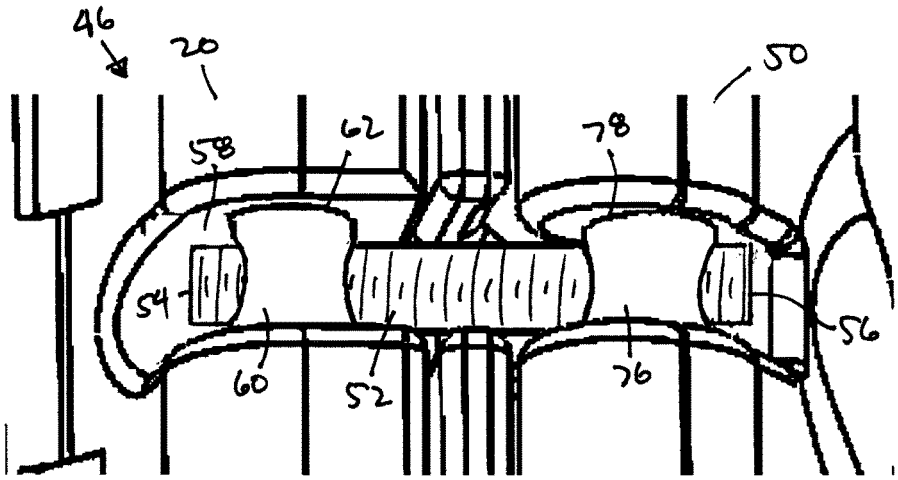
FIG. 9 is a perspective view of a first adjustable lever rod attachment.

In a first adjustable configuration of the pivoting attachment, shown in FIG. 9, a pin 60 extends through aligned, paraxial cuff holes 62 in the trigger half-cylinder free edge 25. The pin 60 can rotate freely in the holes 62. The pin 60 has a threaded hole 68 accessible through a radial slot 58 in the free edge 25 that separates the aligned pin holes 62. The rod cuff end 54 is threaded so that it turns into the threaded hole 68. The pin 60 rotates in the aligned pin holes 62 and is retained in the aligned pin holes 62 by the rod 52 extending perpendicularly from the threaded hole 68 in the slot 58. Optionally, the end 54 of the rod 52 is deformed to prevent it being removed from the threaded hole 68.

Figure 7:
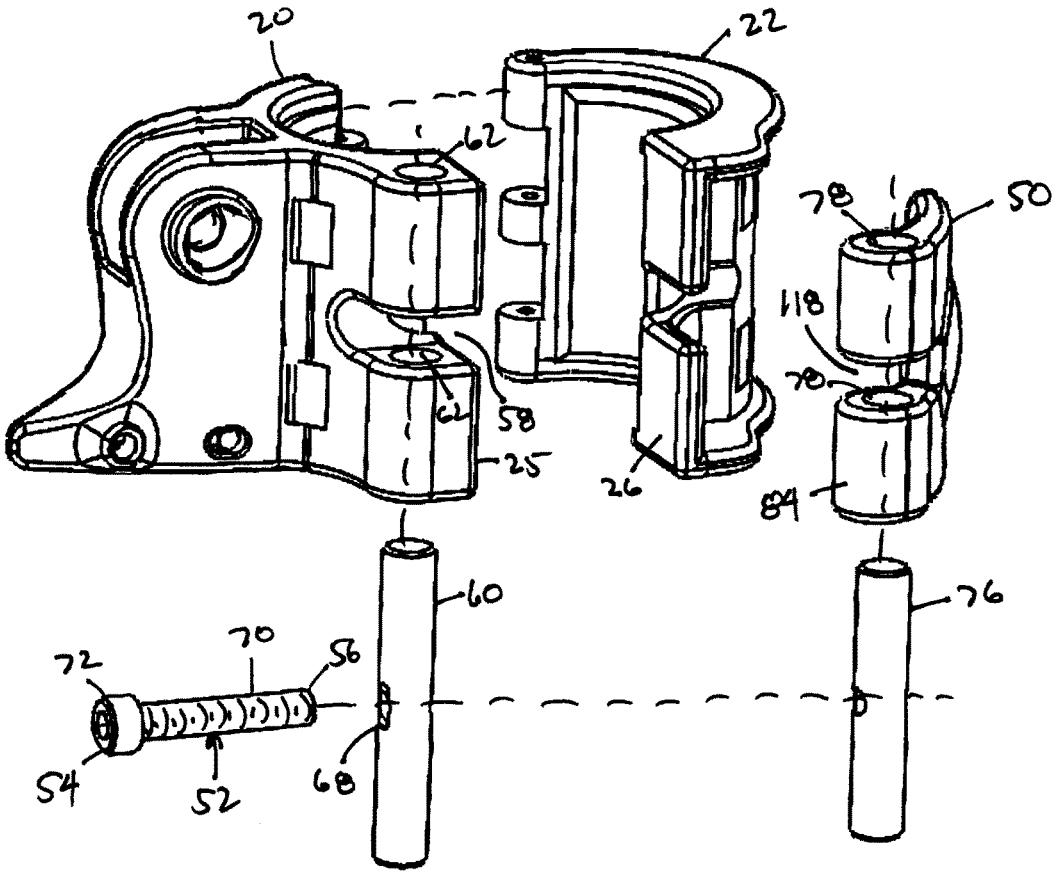
FIG. 7 is a lever side, exploded view of the trigger assembly.
Figure 10:
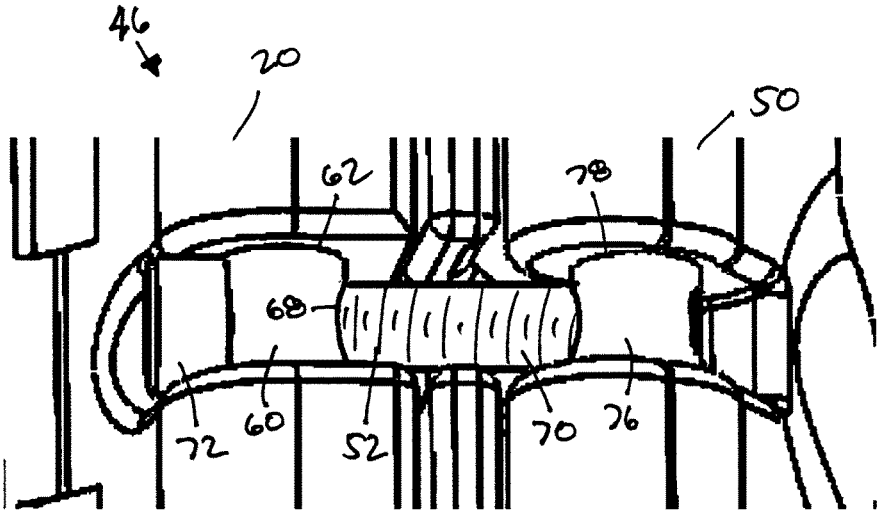
FIG. 10 is a perspective view of a second adjustable lever rod attachment.

In a second adjustable design of the pivoting attachment, shown in FIGS. 7 and 10, a pin 60 extends through aligned, paraxial cuff holes 62 in the trigger half-cylinder free edge 25. The pin 60 can rotate freely in the holes 62. The pin 60 has a threaded hole 68 accessible through a radial slot 58 in the free edge 25 that separates the aligned pin holes 62. The rod 52 is a bolt with a threaded body 70 and a head 72. The body 70 is turned into the threaded hole 68 until the bolt head 72 contacts the pin 60. The pin 60 rotates in the aligned pin holes 62 and is retained in the aligned pin holes 62 by the rod 52 extending perpendicularly from the threaded hole 68 in the slot 58.

The paddle end 56 of the rod 52 can be attached to the bearing end 80 of the paddle 50 by any of the above-described mechanisms using a rotating pin 76 in aligned holes 78 in the bearing end 84 of the paddle 50.

If there is an adjustable mechanism, the length of the rod 52, which determines how tightly the cuff 12 adheres to the pole 2, is adjusted by turning the paddle 50, which causes the rod 52 to rotate in/out in the threaded hole(s) 68.

Figure 11:
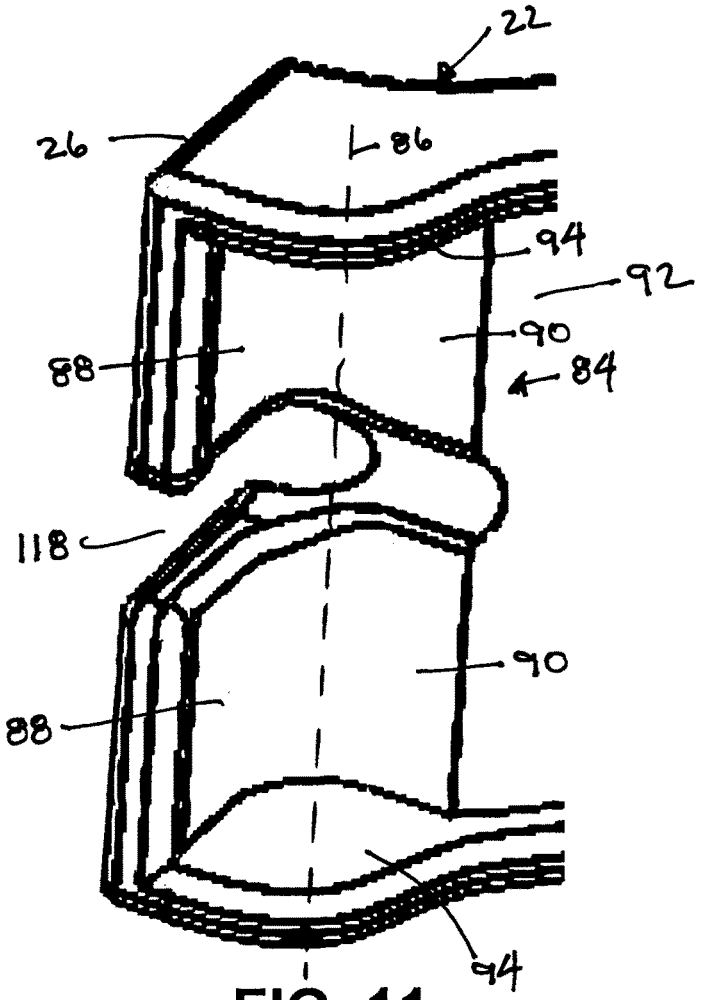
FIG. 11 is a perspective view of the pole half-cylinder bearing surface.

Adjacent to the free edge 26 of the pole half-cylinder 22 is an elongated, concave bearing surface 84, shown in FIG. 11. The bearing surface 84 is a rounded surface of approximately 90° with its axis 86 parallel to the system axis 18. One side 88 of the bearing surface 84 is radial to the system axis 18, and curves through 90° to the other side 90 of the bearing surface 84 that is tangent to the generally cylindrical outer surface 92 of the pole half-cylinder 22. Walls 94 at the front and back ends of the bearing surface 84 provide stability and robustness to the pole half-cylinder 22.

Figure 12:
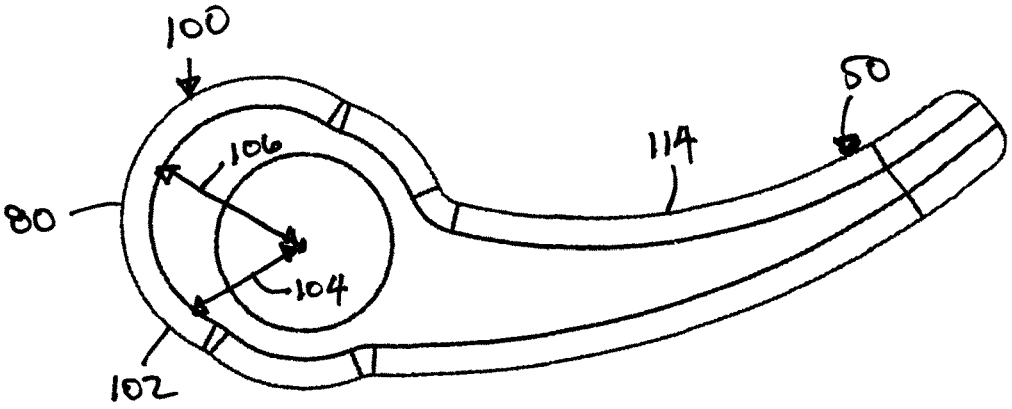
FIG. 12 is an edge view of the lever paddle showing the eccentric cam.
Figure 13:
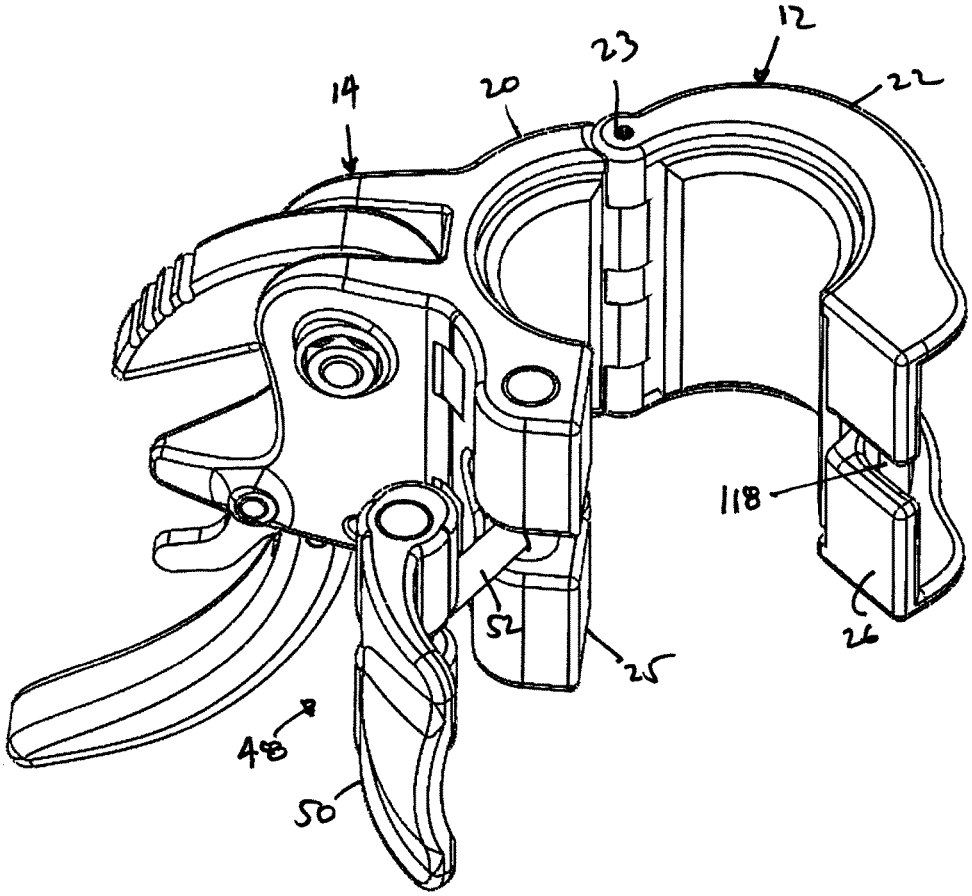
FIG. 13 is a perspective view of the open cuff.
Figure 14:
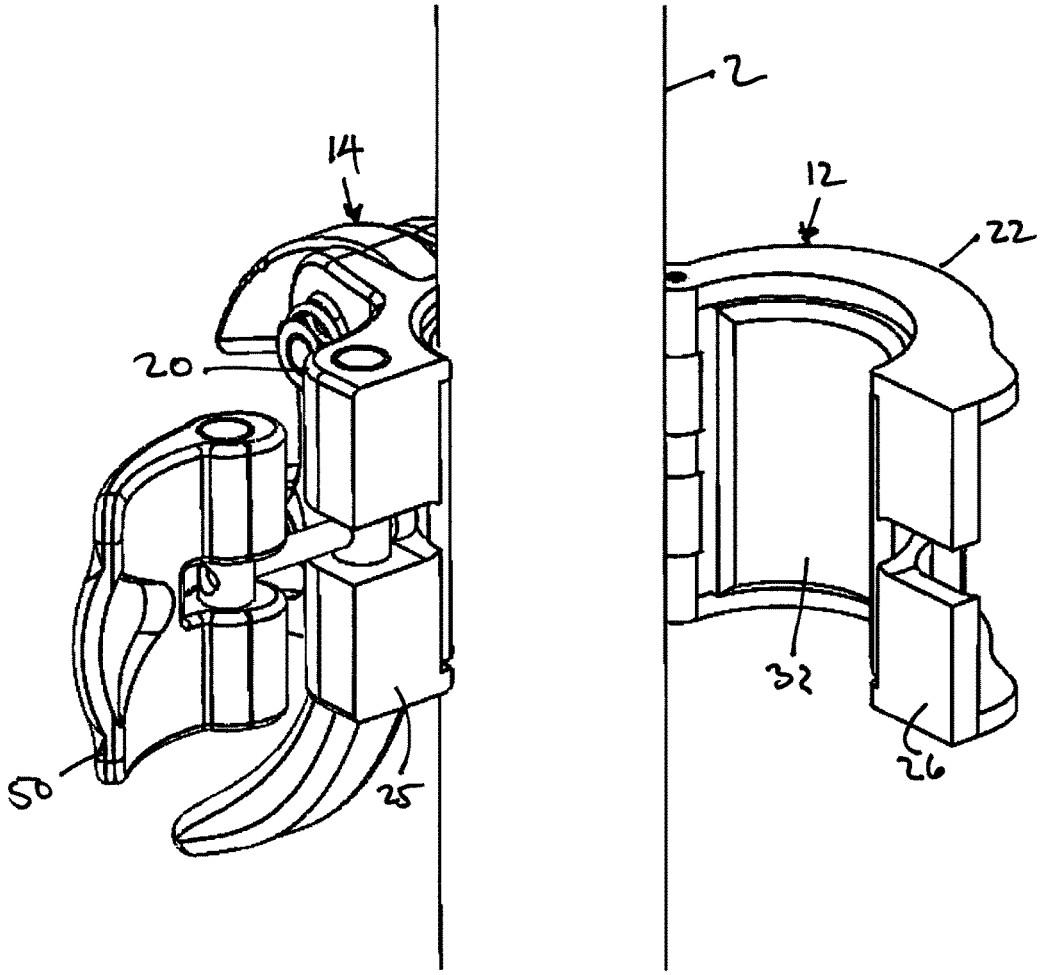
FIG. 14 is a perspective view of the open cuff placed around a pole.

At the bearing end 80 of the paddle 50 is an elongated, convex bearing surface 100. In cross-section, the bearing surface 100 is eccentric, as shown in FIG. 12. The edge 102 of the paddle bearing surface 100 where it initially contacts the pole half-cylinder bearing surface 84 is relatively small in radius, as at 104. Moving around the inside of the bearing surface 100, the radius increases, as at 106.

Optionally, the paddle 50 is curved, as at 114, to follow the outer surface 92 of the pole half-cylinder 22.

Optionally, the paddle 50 fits into a depression 116 in the pole half-cylinder outer surface 92 so that the paddle 50 is generally flush with cuff 12 when attached to the pole 2.

Figure 15:
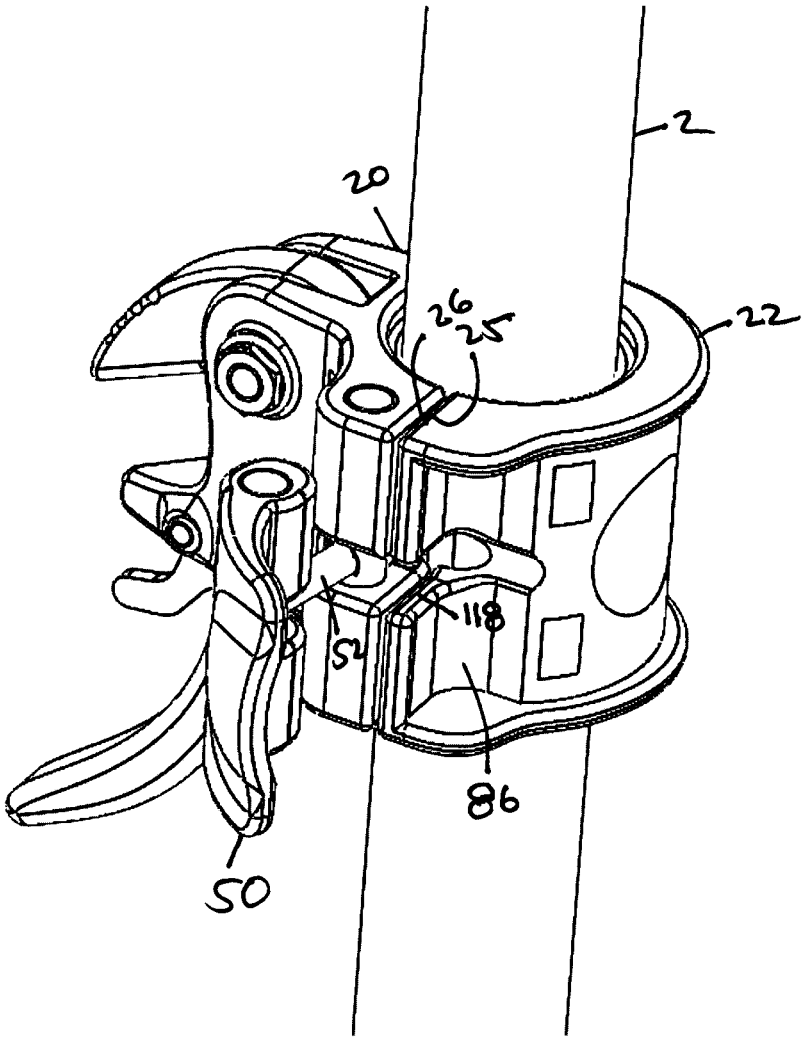
FIG. 15 is a perspective view of the cuff closed around the pole.
Figure 16:
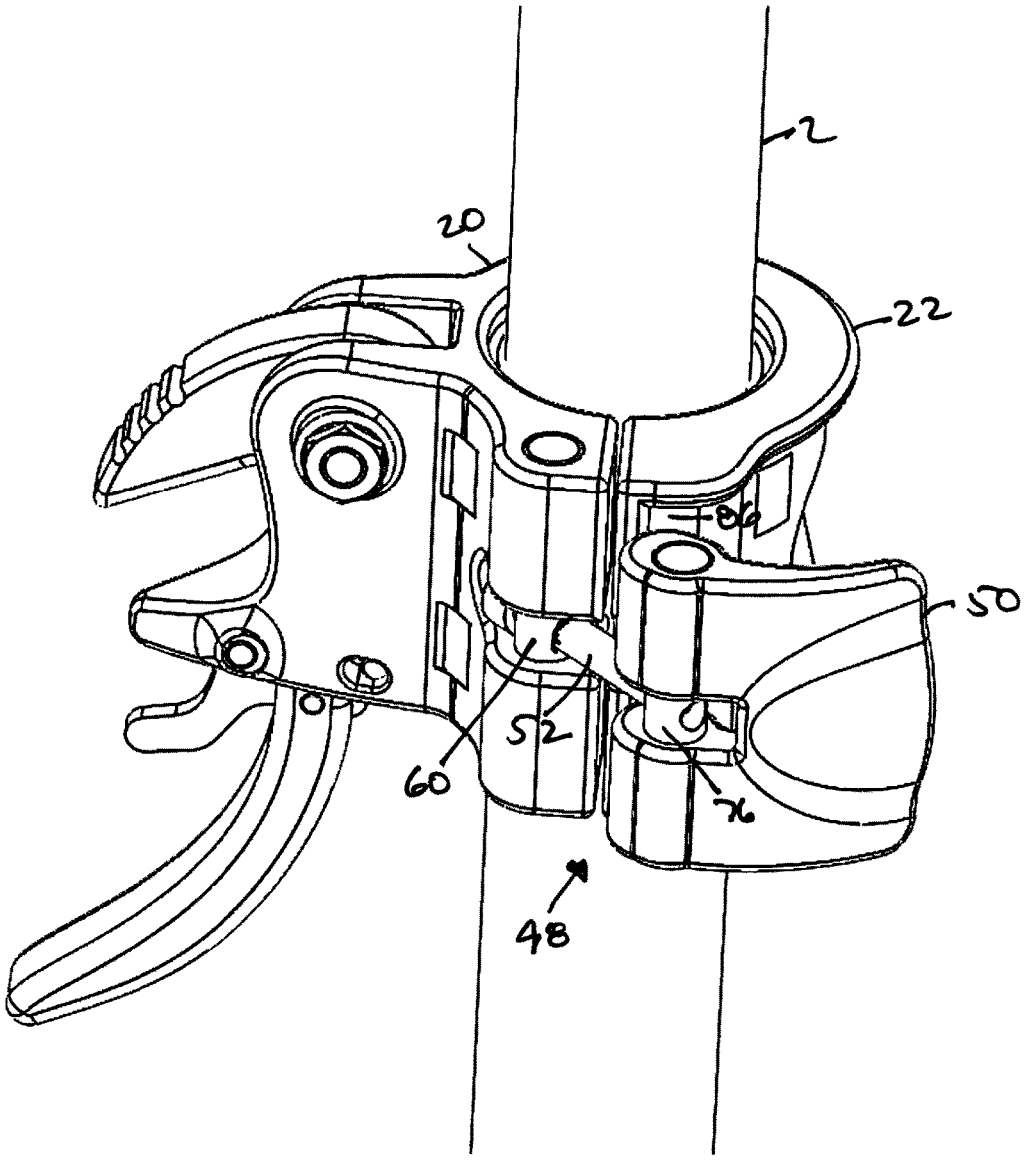
FIG. 16 is a perspective view of the lever pivoted halfway to the pole half-cylinder.
Figure 17:
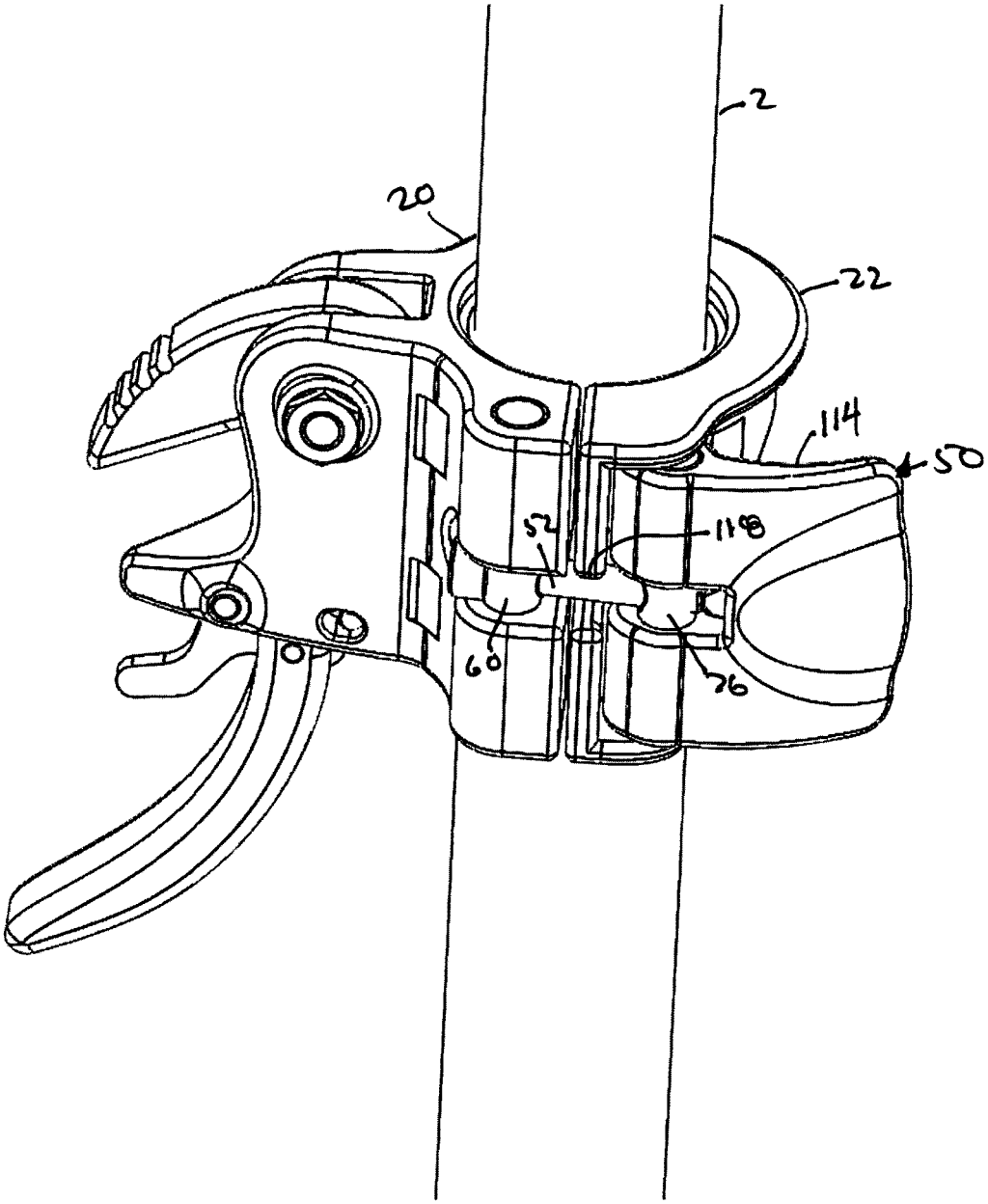
FIG. 17 is a perspective view of the lever pivoted fully to the pole half-cylinder.
Figure 18:
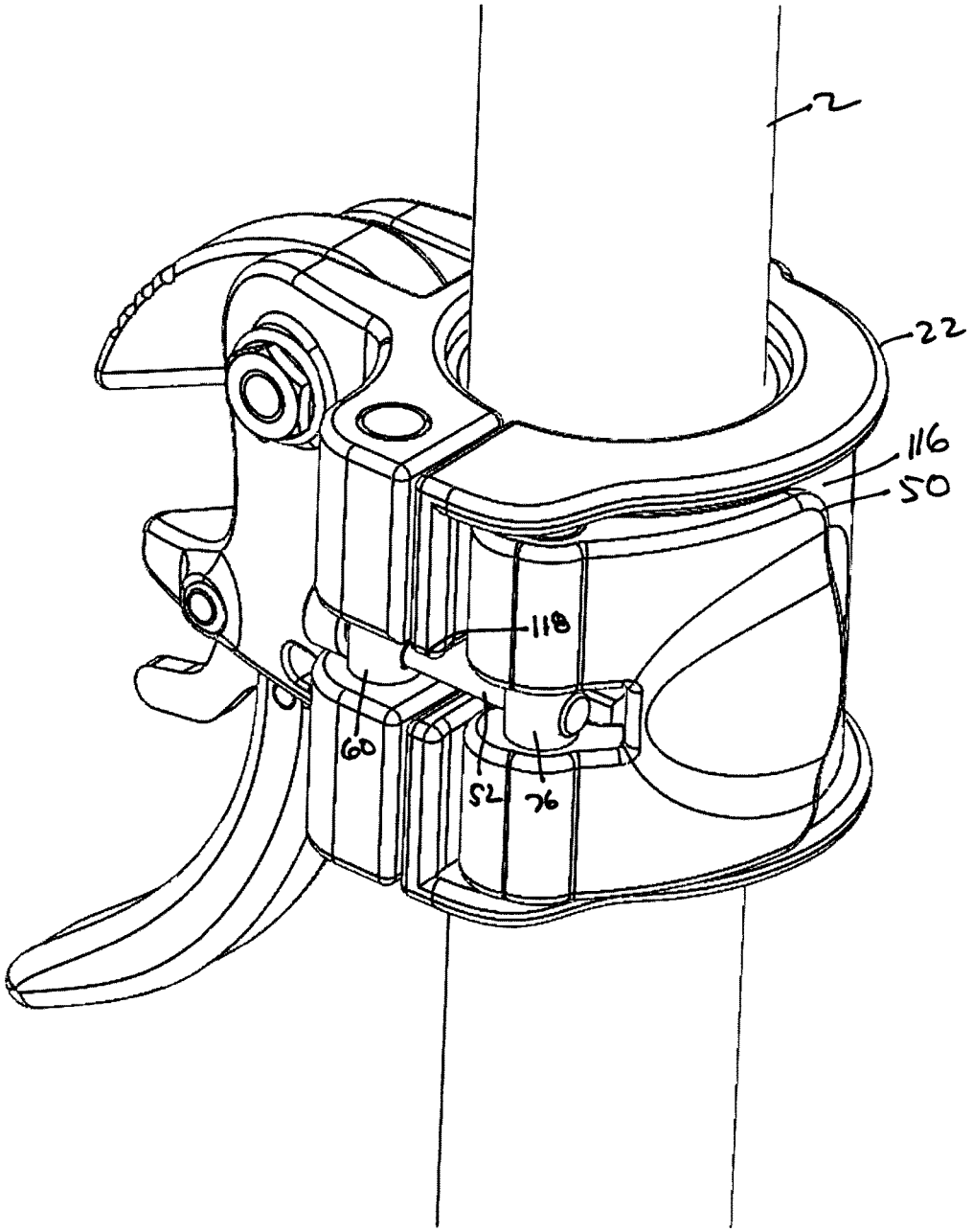
FIG. 18 is a perspective view of the lever pivoted fully engaged.
Figure 19:
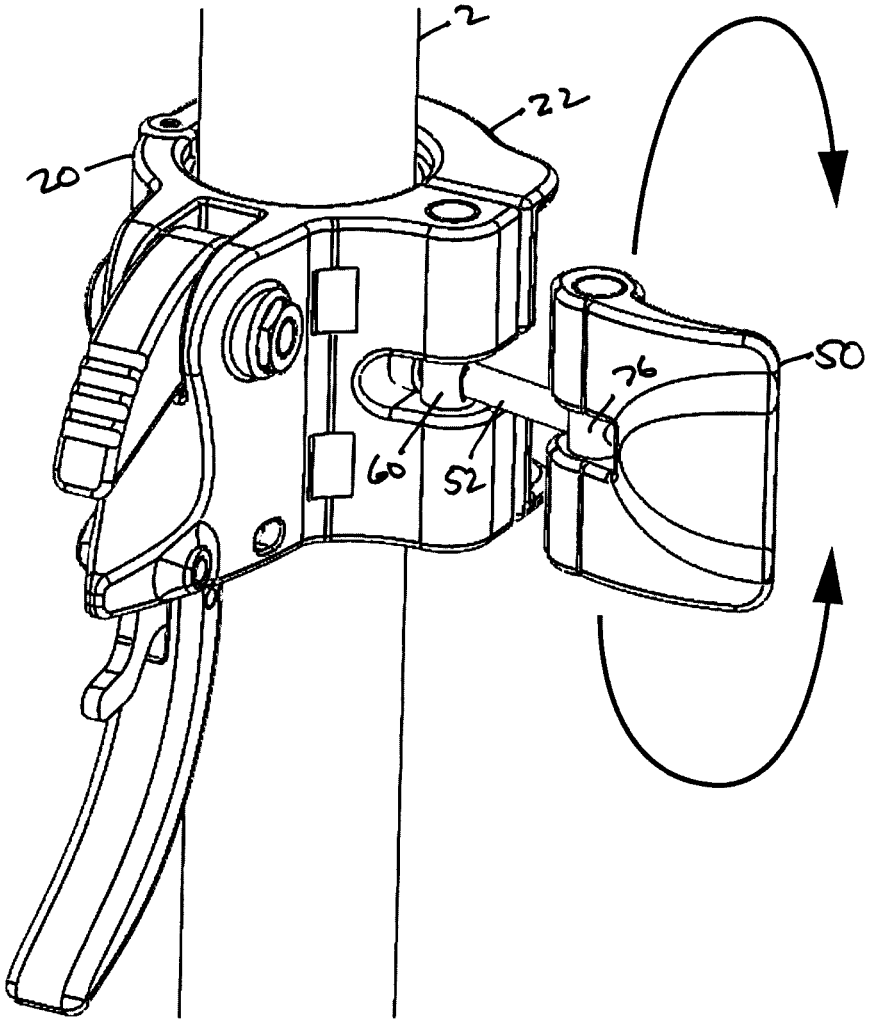
FIG. 19 is a perspective view showing the lever adjustment.

FIGS. 13-18 show how the trigger mechanism is attached to a pole 2 using the quick-release mechanism of the present configuration. In preparation, the two half-cylinders 20, 22 are pivoted apart on the hinge 23, as in FIG. 13. The cuff 2 is placed around the pole 2, as in FIG. 14, and the two half-cylinders 20, 22 are pivoted until the free edges 25, 26 are adjacent to each other, as shown in FIG. 15. As shown in FIGS. 16 and 17, the paddle 50 is pivoted toward the pole half-cylinder 22 until the lever rod 52 is within the pole half-cylinder notch 118 that bisects the pole half-cylinder bearing surface 84 and the paddle bearing surface 100 is in contact with the pole half-cylinder bearing surface 84. The paddle 50 is pivoted inwardly, toward the pole half-cylinder outer surface 92, as shown in FIG. 18. As the paddle 50 pivots inwardly, the radius of the paddle bearing surface 100 in contact with the pole half-cylinder bearing surface 84 increases, pushing the two half-cylinder free edges 25, 26 together and tightening the cuff 12 around the pole 2. If the cuff 12 is too loose or to tight, the length of the rod 52 can be adjusted by rotating the paddle 50 around the rod 52, as shown in FIG. 19.

Figure 20:
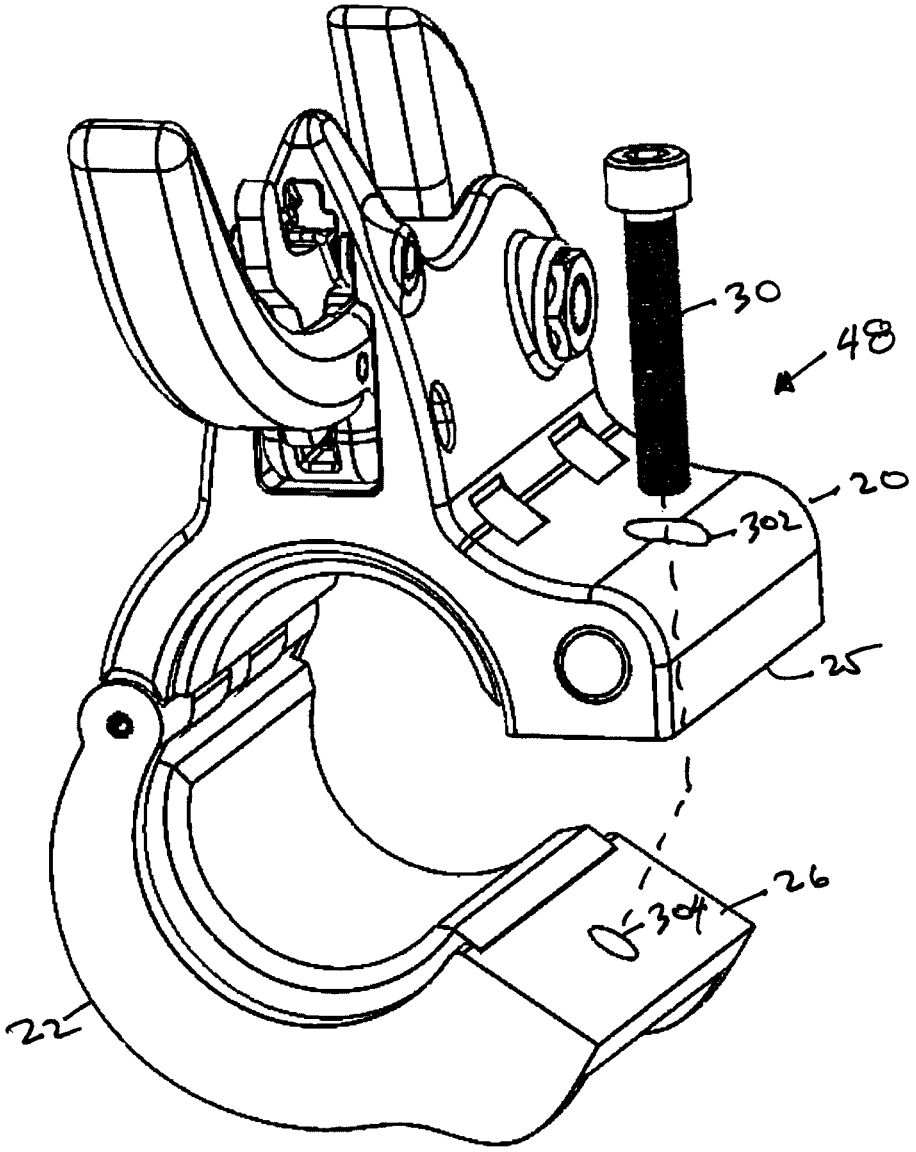
FIG. 20 is a perspective view of a second attachment mechanism.
Figure 21:
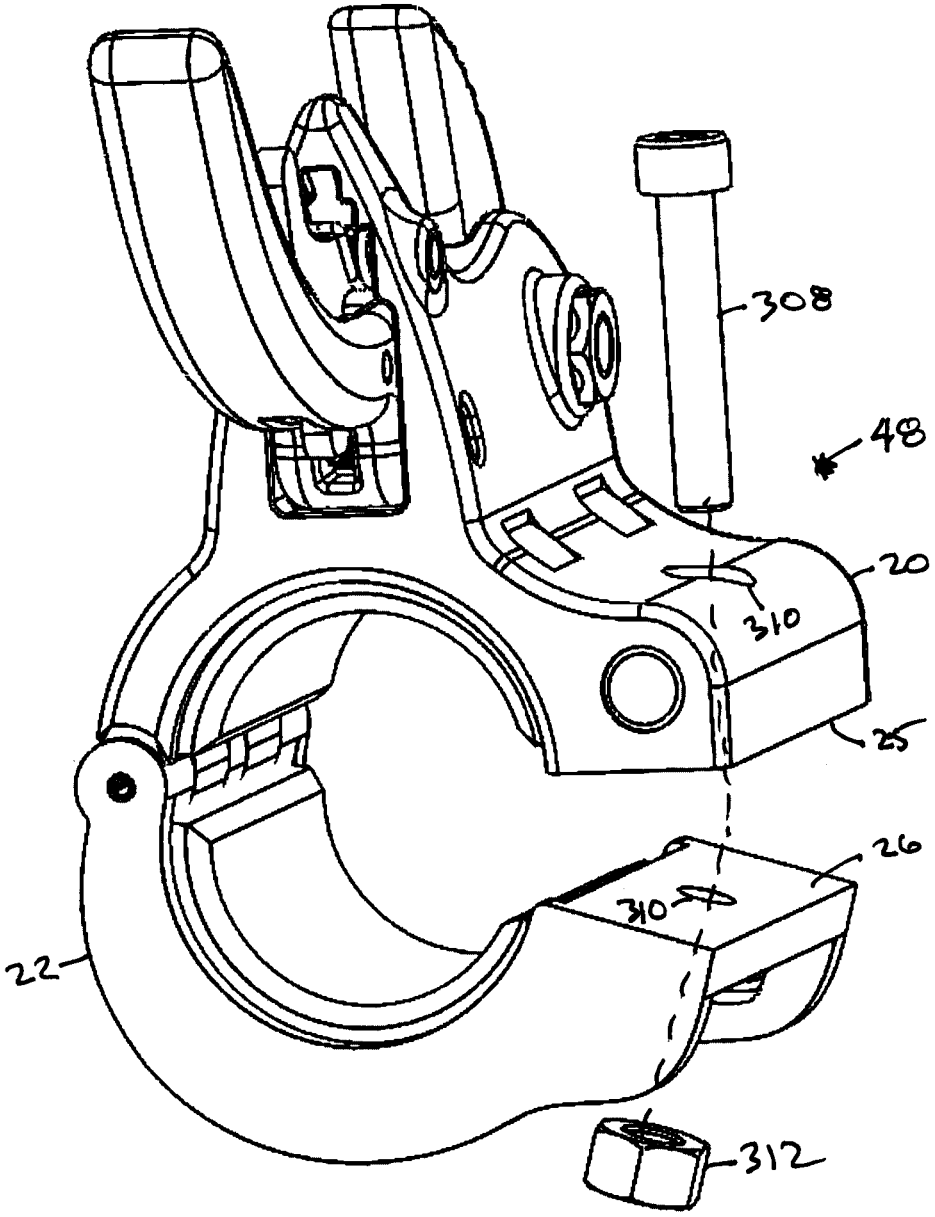
FIG. 21 is a perspective view of a third attachment mechanism.

The present invention contemplates that any attachment mechanism known in the art can be employed. For example, the half-cylinder free edges 25, 26 can be secured together by one or two bolts. In one configuration, shown in FIG. 20, each bolt 300 extends through a hole 302 in one of the half-cylinder free edges 25, 26 and turns into a threaded hole 304 in the other half-cylinder free edge 25, 26. Alternatively and as shown in FIG. 21, a bolt 308 extends through aligned holes 310 in the half-cylinder free edges 25, 26 and is secured by a nut 312. Optionally, the nut 312 can be a wing nut that can be finger tightened.

As shown in FIGS. 22-26, the trigger mechanism 14 is in a housing 148 located on the outside surface of the trigger half-cylinder 20. The details of the housing 148 are described as it relates to each component of the trigger mechanism 14.

The trigger 150 is an elongated, optionally curved, finger. One end of the trigger 150 has an approximately 90° bend 152 to form a stem 154. There is a hole 158 transversely through the stem 154 at the pivot end 156 of the stem 154. The stem 154 fits into a radial slot 160 at the rear 162 of the housing 148 such that the stem 154 extends radially from the system axis 18 and the trigger 150 extends rearwardly. A pin 164 extends through aligned holes 166 in the sides of the housing 148 bracketing the stem 154 and through the pivot hole 158 in the stem pivot end 156. The trigger 150 pivots on the pin 164 perpendicularly to the system axis 18 in the housing 148.

Figure 26:
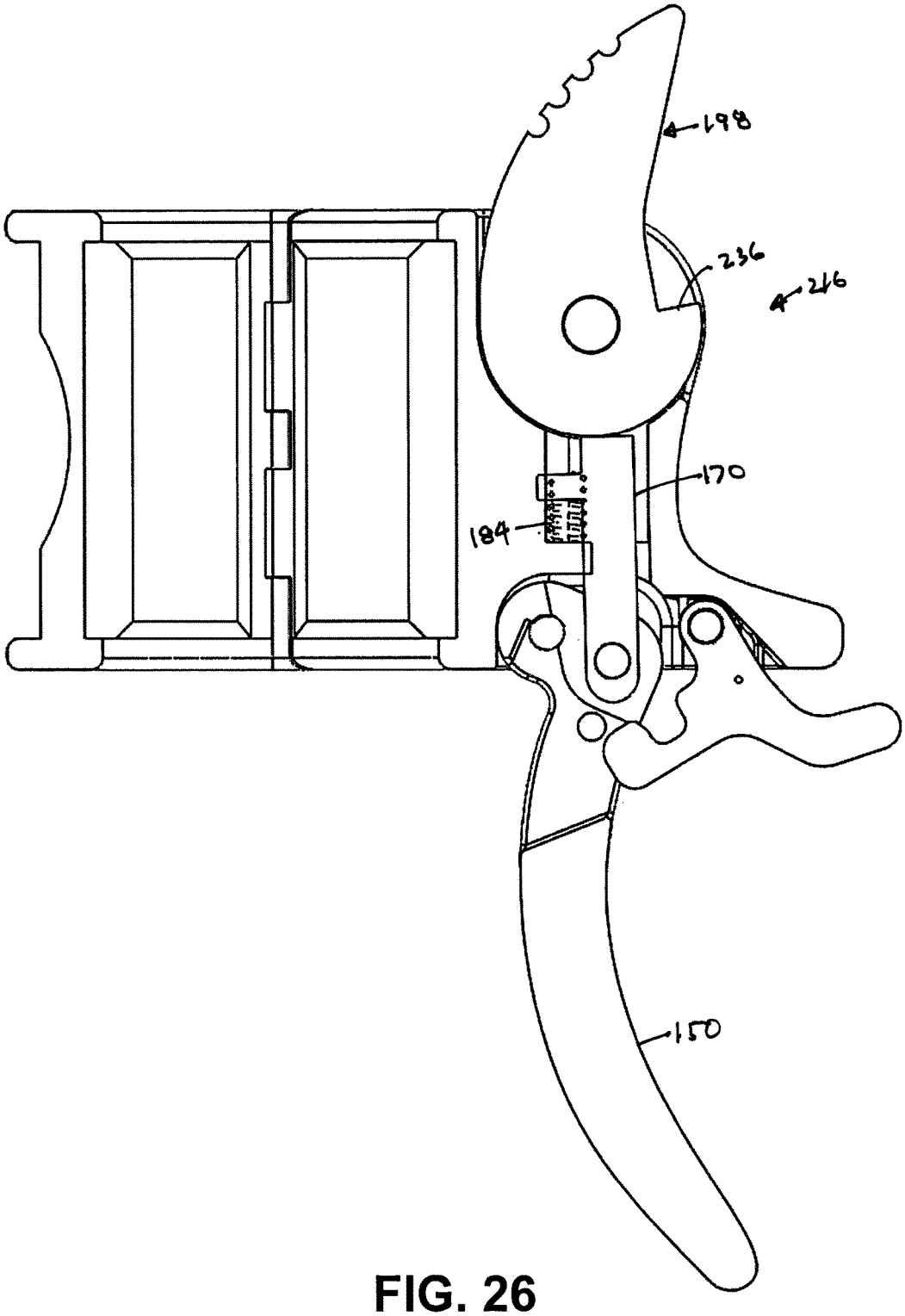
FIG. 26 is a side, cross-sectional view of the trigger assembly in the release position.

A release bar 170 extends paraxially in a channel 182 in the housing 148. At the trigger end 172 at the rear of the release bar 170 is a transverse through hole 174. The release bar trigger end 172 fits into a radial slot at the front of the trigger bend 152. A pin 178 extends through aligned holes 180 in the sides of trigger 150 bracketing the release bar 170 and through the hole 174 in the release bar 170. Because the release bar pin 178 is spaced from the trigger pin 164, when the trigger 150 is pulled inwardly toward the system axis 18 (toward the pole 2), the trigger 150 pulls the release bar 170 rearwardly, as seen in FIG. 26.

A coil spring 184 biases the release bar 170 toward the front. The spring 184 extends between a wall 186 in the housing 148 and a stop 188 extending inwardly from the release bar 170. When the trigger 150 is pulled, the release bar 170 is pulled rearwardly, causing the stop 188 to compress the spring 184 against the wall 186, as seen in FIG. 26. When the trigger 150 is released, the spring 184 pushes the release bar 170 forwardly, thereby pulling the trigger 150 to the normal position. The figures show the spring 184 inwardly of the release bar 170. However, the spring 184 can be located anywhere it can be effective, such as outside of the release bar 184 or surrounding the release bar 170.

Figure 1:
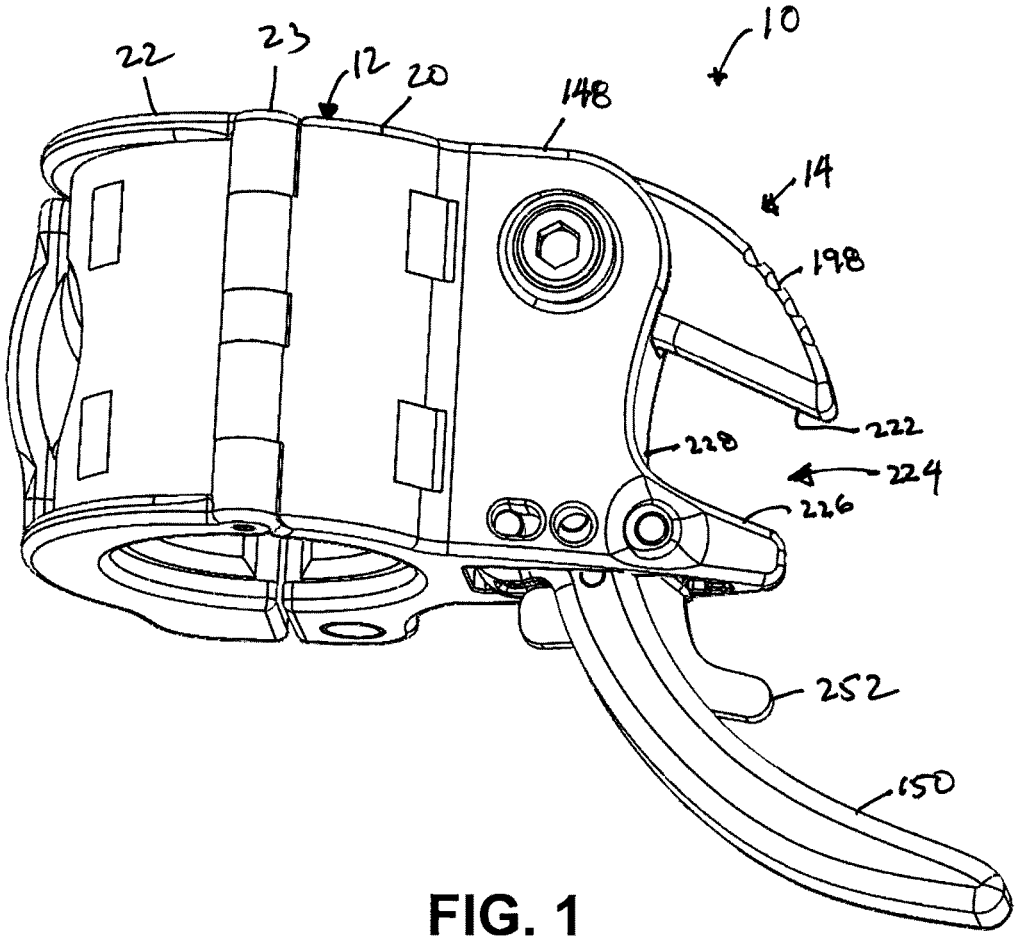
FIG. 1 is a hinge side, perspective view of the trigger assembly of the present invention.
Figure 2:
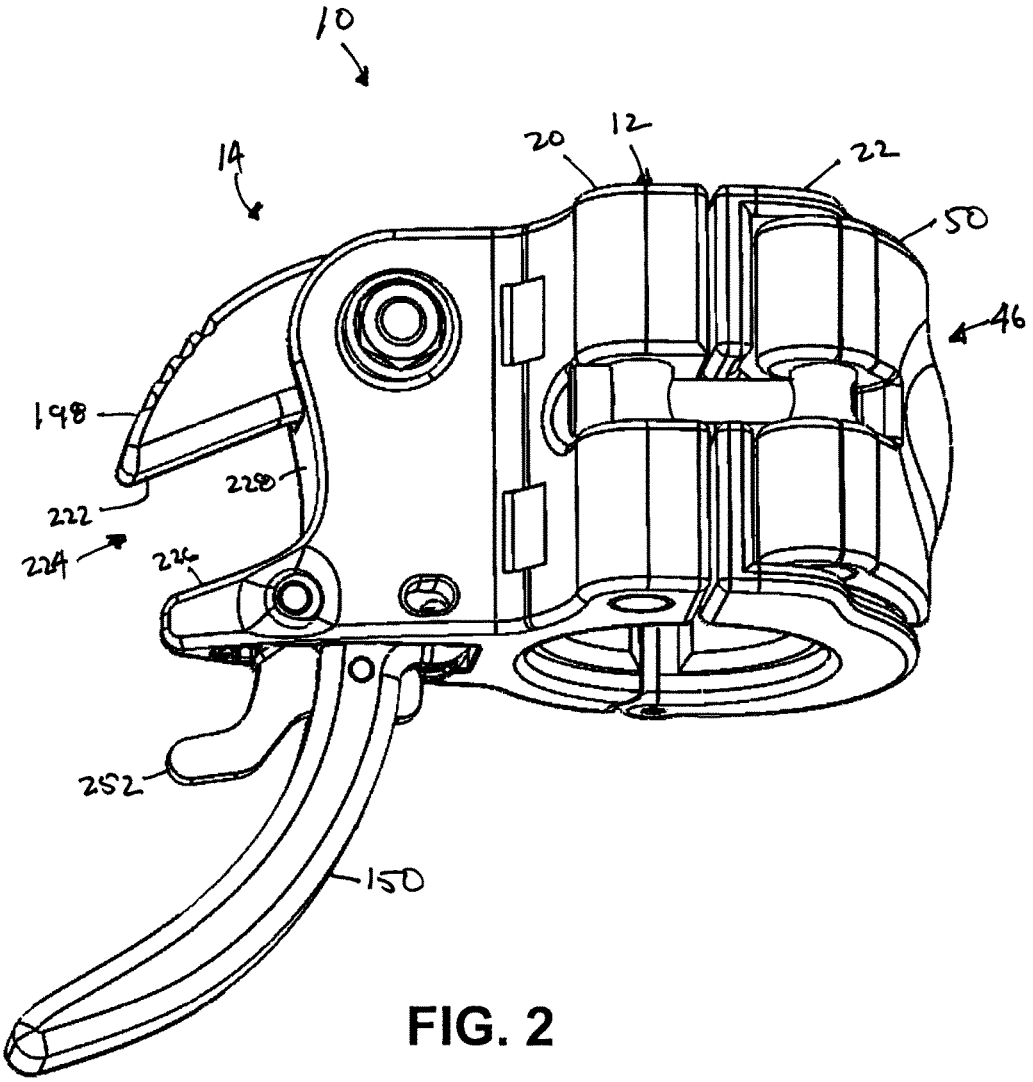
FIG. 2 is a lever side, perspective view of the trigger assembly of the present invention.
Figure 23:
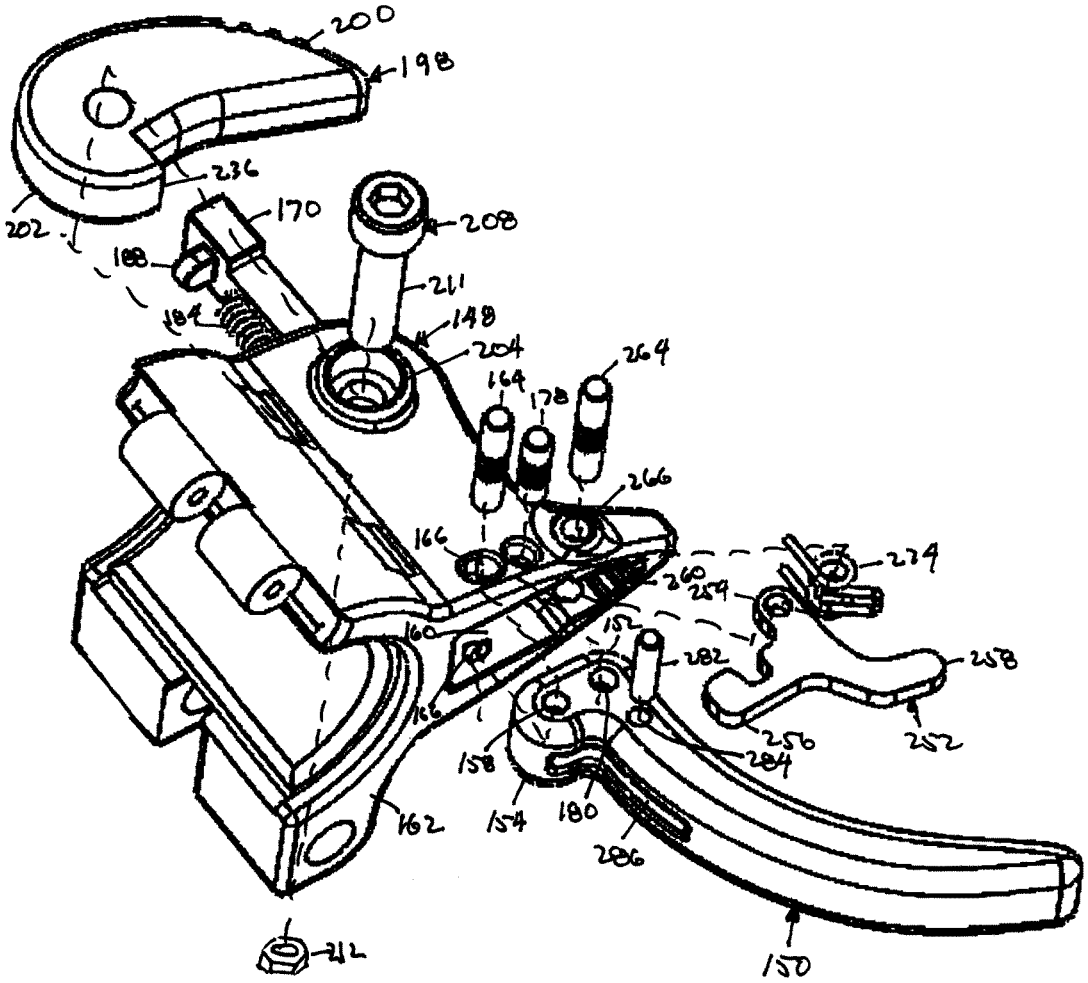
FIG. 23 is an exploded view of the trigger assembly.
Figure 28:
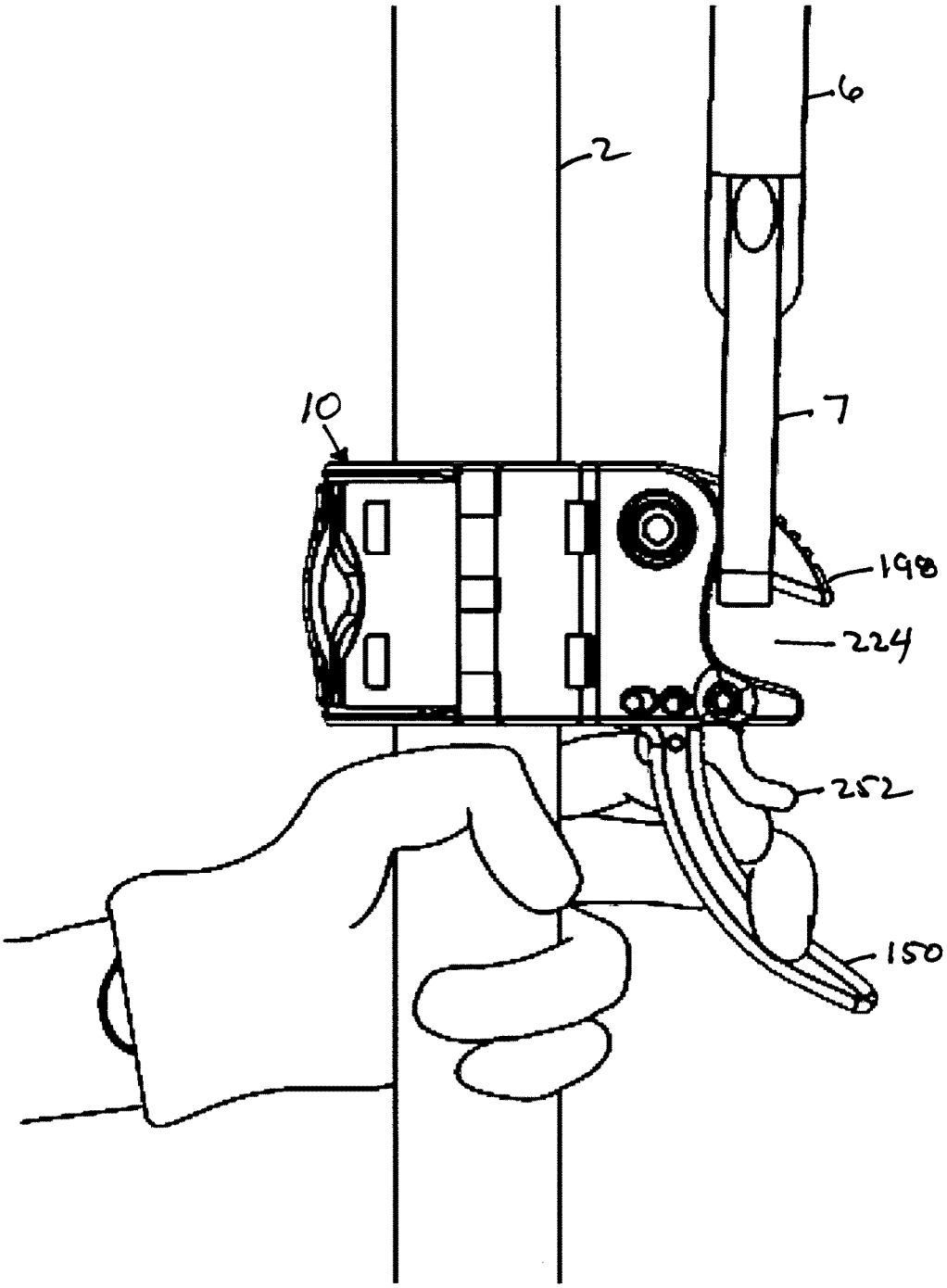
FIG. 28 is a side view of the trigger assembly in use in the capture position.

The launcher loop 7 is held in the trigger assembly 10 by the catch 198, as seen in FIG. 28. The catch 198 is a generally wedge-shaped component that includes an arm 200 extending from a pivot 202. The pivot 202 is semicircular with a pivot hole 204 at the center. The pivot 202 fits into a radial slot 206 in the front of the housing 148. A pin 208 extends through aligned holes 210 in the sides of the housing 148 bracketing the pivot 202 and through the pivot hole 204 in the pivot 202. The catch 198 pivots on the pin 208 within the housing 148 between a capture position 214 and a release position 216, described below. Because of the stresses involved with the launcher 1, the pin 208 is large and robust. In the present design, the pin 208 is a bolt 211 and nut 212, as seen in FIGS. 2 and 23.

The arm 200 extends from the pivot 202 generally opposite the middle 220 of the semicircle. In the capture position 214, the rear edge 222 of the arm 200 slopes outwardly and rearwardly from the pivot 202 and forms a notch 224 with a hollow 228 in the outer surface 226 of the housing 148. The front edge 230 of the hollow 228 acts as a stop for the catch 198 when pivoting rearwardly to the capture position 214. The notch 224 retains the launcher loop 7 as described below.

At the junction between the pivot 202 and arm 200 at the rear of the catch 198 is a ledge 236 radial to the pivot pin 208. The ledge 236 faces outwardly and extends toward the pivot hole 204. In the capture position 214, the ledge 236 is generally parallel to the system axis 18.

Figure 22:
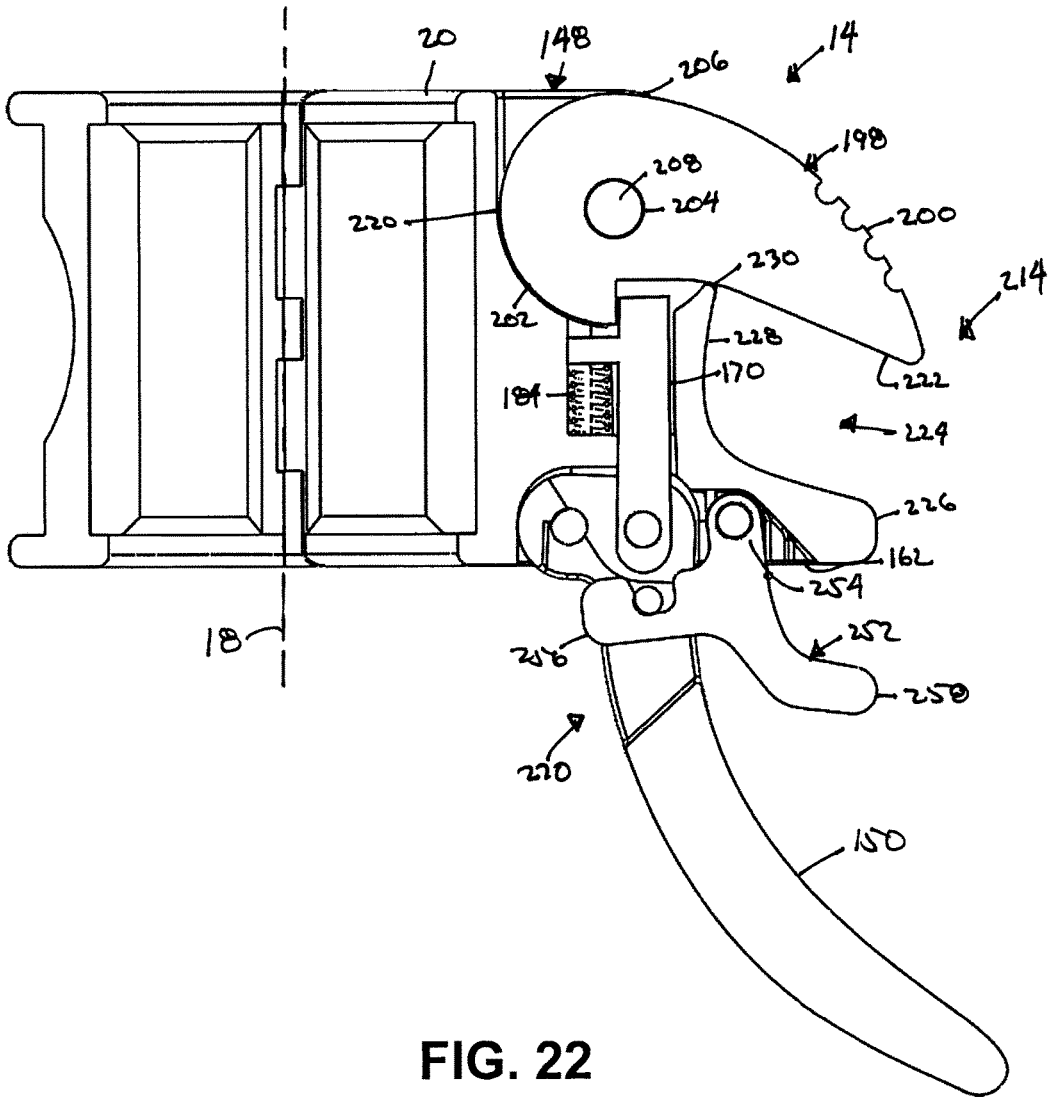
FIG. 22 is a side, cross-sectional view of the trigger assembly in the capture position.

The ledge 236 and release bar 170 operate together to retain the catch 198 in the capture position 214. When in the capture position 214, the trigger spring 184 pushes the release bar 170 forwardly and outwardly of the ledge 236 so that the catch end 190 at the front of the release bar 170 overhangs the ledge 236, as seen in FIG. 22. When frontward pressure is put on the rear edge 222 of the arm 200, the ledge 236 hits the release bar catch end 190. The release bar 170 is captured in the channel 182 to prevent the release bar 170 from moving outwardly against pressure from the ledge 236, thereby preventing the catch 198 from pivoting forward. When the trigger 150 is pulled inwardly, the release bar 170 is pulled downwardly, so that it no longer abuts the ledge 236, permitting the catch 198 to pivot to the release position 216, as in FIG. 26.

The present design incorporates an optional safety latch mechanism 250 to prevent inadvertent operation of the trigger mechanism 10. The main element of the latch mechanism 250 is the latch 252. The latch 252 is a flat sheet of rigid material, such as a metal or plastic, with three components: a pivot 254, a hook finger 256, and a release lever 258. The pivot 254 fits into a latch slot 260 in the housing 148 outside of the trigger stem bend slot 160. The latch slot 260 and the trigger stem bend slot 160 may be the same slot. A latch pivot pin 264 extends through aligned holes 266 in the sides of the housing 148 bracketing the latch pivot 254 and through a pivot hole 268 in the latch pivot 254. The latch 252 pivots on the pin 264 perpendicularly to the system axis 18 between a latched position 270 and an unlatched position 272, as explained below. A torsion spring 274 mounted on the pin 264 biases the latch 252 in the latched position 270.

Figure 24:
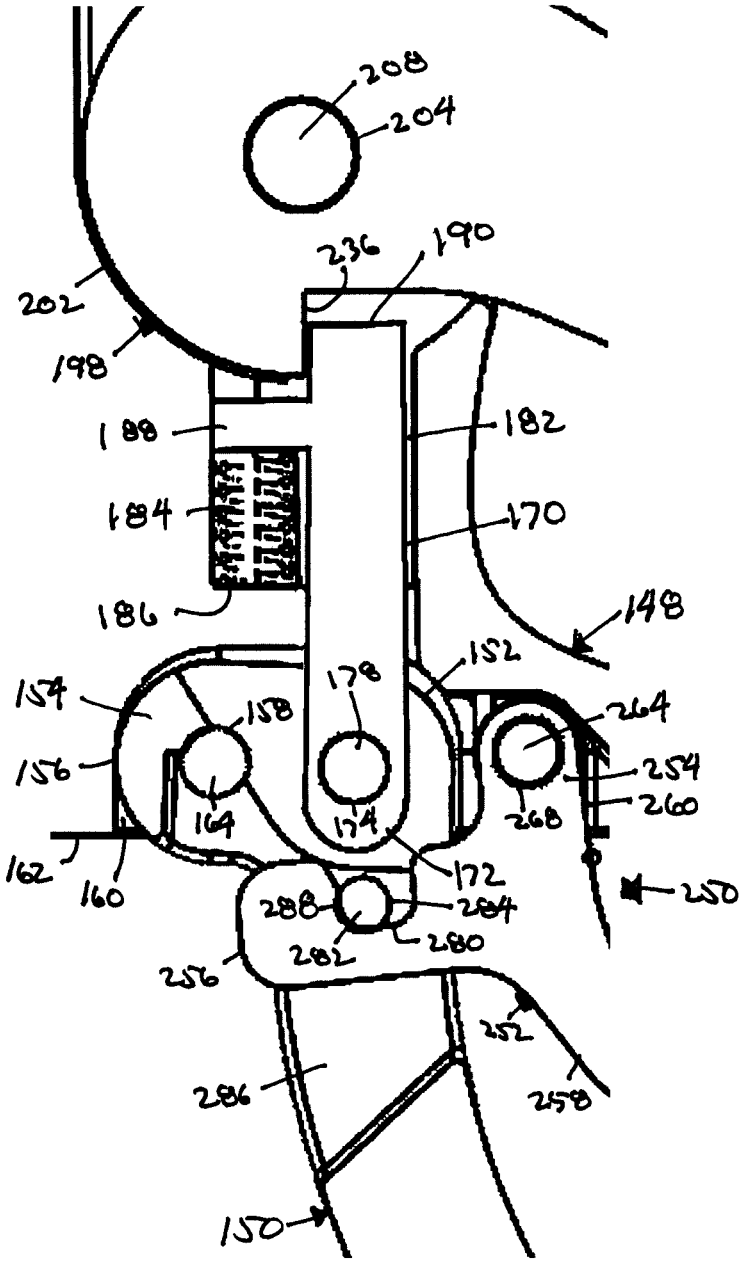
FIG. 24 is a detailed view of the trigger assembly in the capture position.

The latch hook finger 256 has a forward-facing hook notch 280. The notch 280 fits around a latch pin 282 in the trigger 150. A pair of aligned holes 284 straddle a slot 286 in the trigger 150 rearwardly of the stem bend 152. The pin 282 extends between the holes 284 transversely across the slot 286. In the latched position 270, the pin 282 is within the notch 280 and the inside wall 288 of the notch 274 prevents the trigger 150 from being pulled, as seen in FIGS. 22 and 24.

Figure 25:
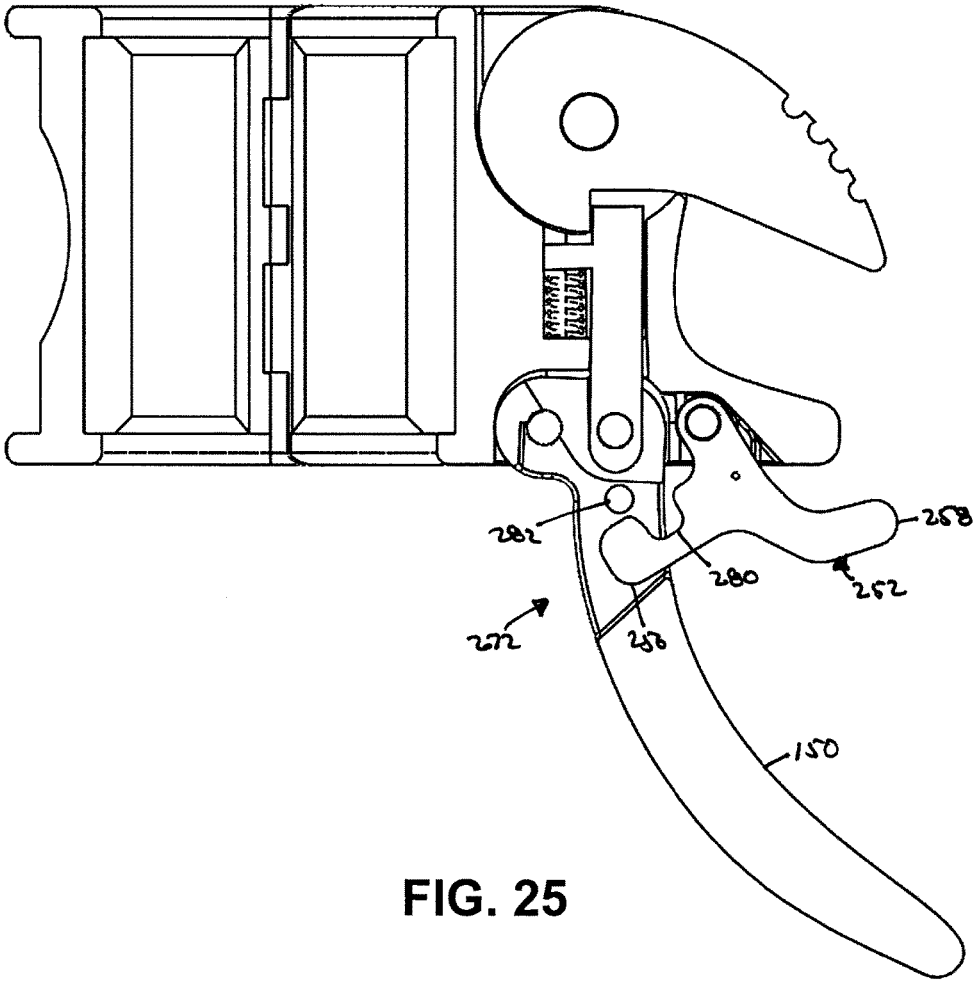
FIG. 25 is a side, cross-sectional view of the trigger assembly in the unlatched position.

The latch release lever 258 enables the user to disengage the latch 252. The lever 258 extends rearwardly and outwardly from the pivot 254 and hook 256. When the lever 258 is pushed outwardly to the unlatched position 272, the hook 256 is removed from the pin 282, as seen in FIG. 25, enabling the user to pull the trigger 150. When pressure is released from the lever 258, the spring 274 biases the latch 252 back to the latched position 270.

Figure 27:
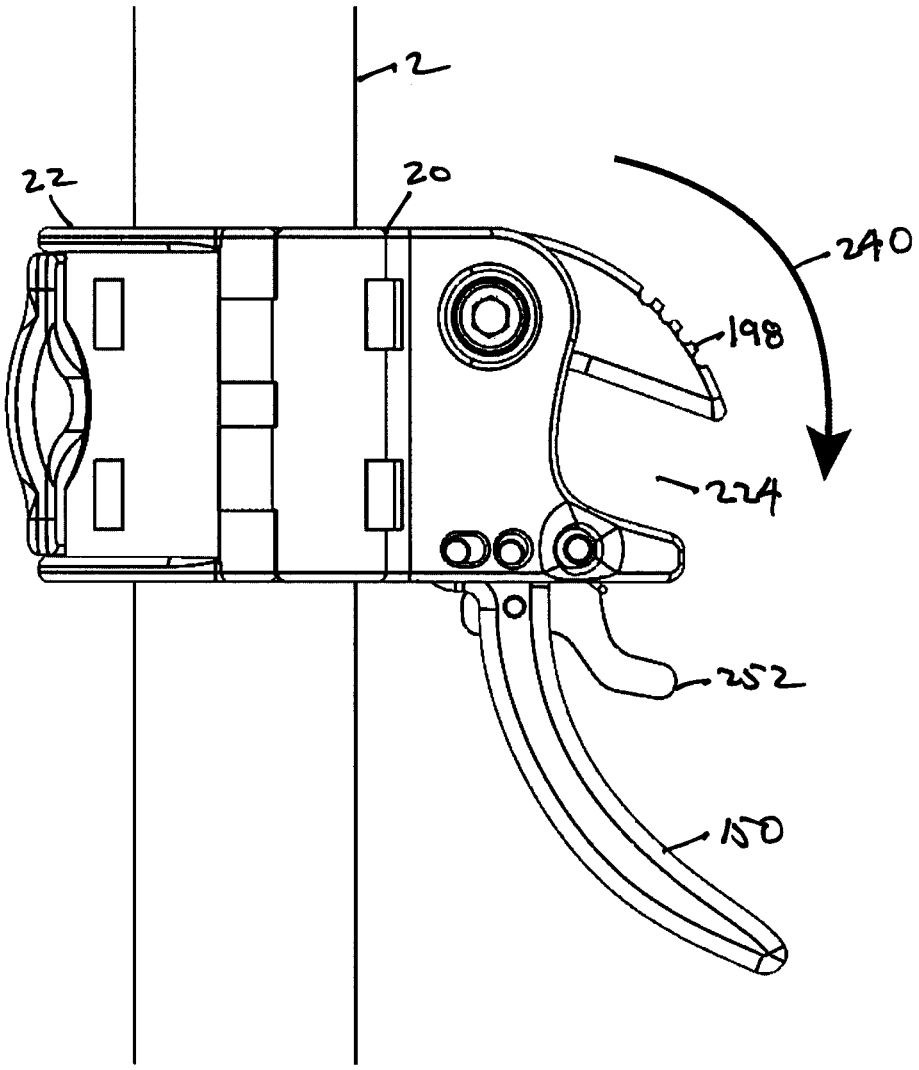
FIG. 27 is a side view of the trigger assembly in being put in the capture position.

To use the trigger mechanism 10, it is first put in the capture position 214. In the capture position 214, the catch 198 is pivoted fully backward to the hollow 228 to form the notch 224, as at 240 in FIG. 27. The trigger 150 is pivoted fully outward so that the release bar 170 is biased fully forward over the ledge 236. The safety mechanism 250 is engaged in the latched position 270, with the latch 252 in the latched position such that the latch pin 282 of the trigger 150 is within the hook notch 280. Once the trigger mechanism 10 is in the capture position, the launcher loop 7 is pulled back and hooked around the catch 198, resting in the notch 224, as in FIG. 28.

Figure 29:
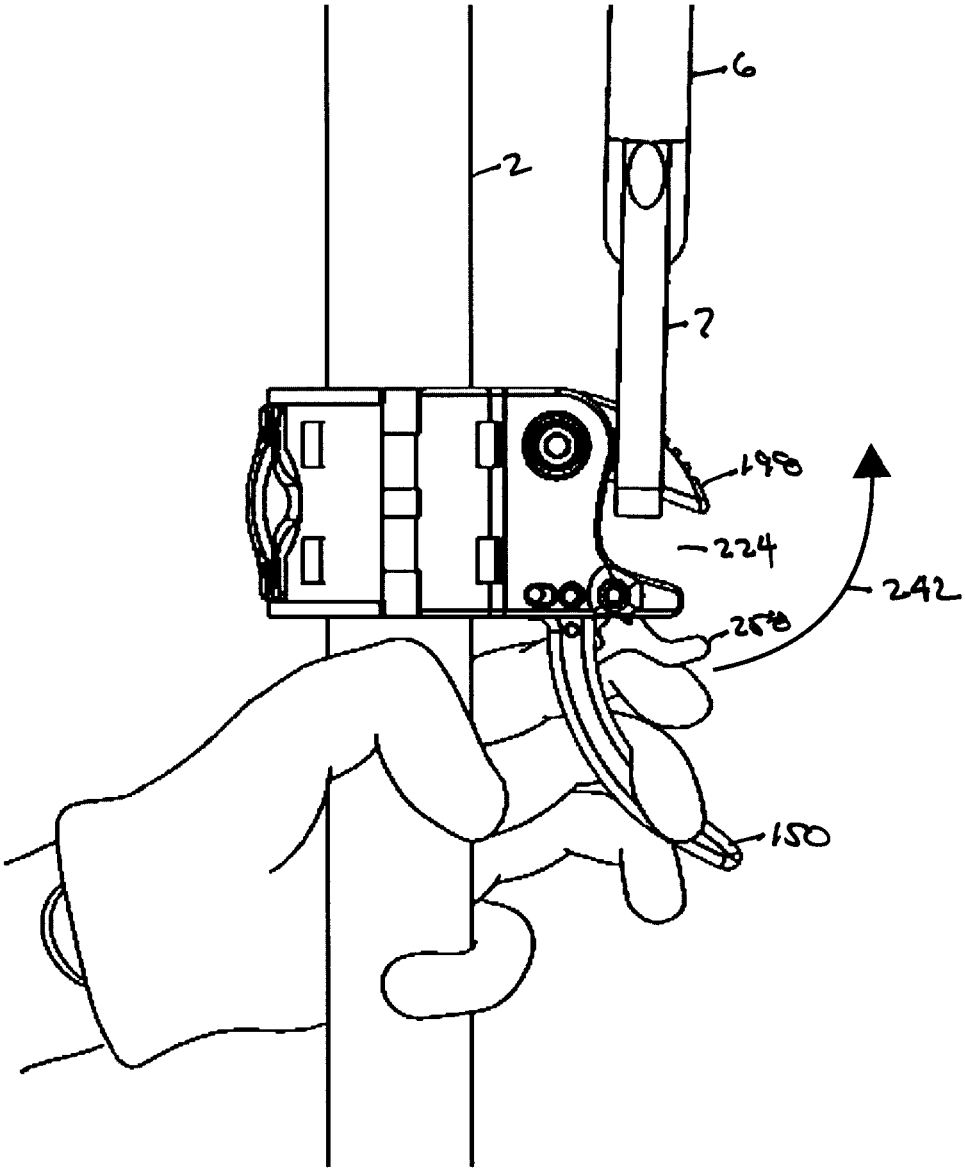
FIG. 29 is a side view of the trigger assembly in use in the unlatched position.

To prepare to release the loop 7, the operator first pushes the latch release lever 258 outwardly, as at 242 in FIG. 29, to the unlatched position 272, thereby disengaging the latch mechanism 250.

Figure 30:
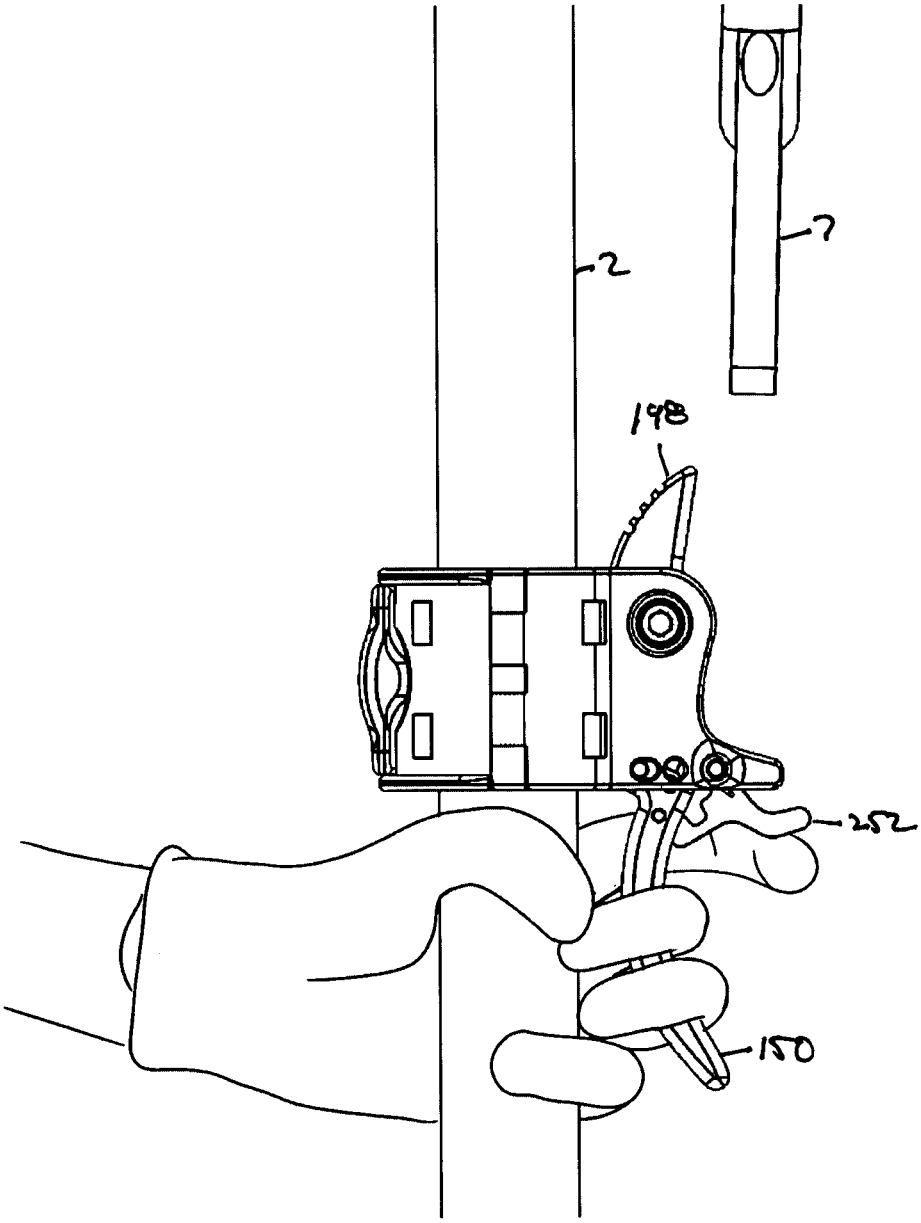
FIG. 30 is a side view of the trigger assembly in use in the release position.

To release the loop 7, with the latch mechanism 250 disengaged, the operator pulls the trigger 150. As the trigger pivots inwardly, it pulls the release bar 170 from the catch ledge 236. The forward force of the loop 7 pulls the catch 198 forwardly, thereby releasing the loop 7 to fly forwardly, as shown in FIG. 30.

The components of the trigger assembly is are composed of rigid materials, such as rigid plastics, composites, and/or metals. One preferred plastic is ABS for its strength and rigidity. The pins are typically made of metal, such as steel, for its strength.

Thus it has been shown and described a projectile launcher trigger. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. A trigger assembly for a projectile launcher comprising:

(a) a cylindrical hub having a central system axis, the hub comprised of a trigger half-cylinder with a hinge edge and a free edge and a pole half-cylinder with a hinge edge and a free edge, the trigger half-cylinder hinge edge and the pole half-cylinder hinge edge being attached by a hinge to pivot paraxially with the system axis;

(b) an attachment mechanism for securing the trigger half-cylinder free edge and the pole half-cylinder free edge together;

(c) a trigger mechanism mounted in a trigger housing on the trigger half-cylinder, the trigger housing having an outer surface, the trigger mechanism comprising:

(1) an elongated trigger having a first end and a second end, an approximately 90° bend to a stem at the first end, the stem having a pivot end opposite the bend, the pivot end being mounted in the trigger housing to pivot perpendicularly to the system axis, the second end extending back and outwardly from the trigger housing;

(2) a release bar with a trigger end and a catch end, the release bar mounted to reciprocate paraxially with the system axis in a channel in the trigger housing, the trigger end mounted to pivot perpendicularly to the system axis at the trigger bend;

(3) a spring mounted to bias the release bar forwardly; and (4) a catch mounted in the trigger housing to pivot perpendicularly to the system axis and having an arm extending away from the pivot, the catch pivoting between a capture position wherein the arm extends outwardly and rearwardly and forming a notch with a hollow on the trigger housing outer surface, and a release position wherein the arm extends generally forwardly, the catch having a ledge such that, when in the capture position, the catch end of the release bar overhangs the ledge to prevent pivoting of the catch;

(d) whereby, when the trigger is pulled inwardly, the release bar is pulled rearwardly away from the catch ledge, permitting the catch to pivot forwardly.

2. The trigger assembly of claim 1 further comprising a latch mechanism comprising:

(a) a latch mounted in the trigger housing outside of the trigger to pivot perpendicularly to the system axis, the latch having a hook finger with a forward facing hook notch with an inside wall and latch release lever extending outwardly and rearwardly;

(b) a latch pin extending transversely through a slot in the trigger rearwardly of the stem bend; and (c) a spring biasing the latch in a latched position where the latch pin is in the hook notch, preventing the trigger from being pulled inwardly;

(d) whereby, when the latch release lever is pushed outwardly to an unlatched position, the latch pin is not in the hook notch and the trigger can be pulled inwardly.

3. The trigger assembly of claim 1 wherein the attachment mechanism comprises:

(a) a lever rod having a cuff end and a paddle end, the cuff end attached to the trigger half-cylinder free edge to pivot paraxially to the system axis;

(b) a paddle having a bearing end and free end, the paddle bearing end attached to the lever rod paddle end to pivot paraxially to the system axis, the paddle bearing end having an elongated, convex bearing surface extending paraxially to the system axis, the bearing surface shaped as an eccentric cam in cross-section; and (c) an elongated, concave bearing surface adjacent to the pole half-cylinder free edge, the concave bearing surface bisected by a notch aligned with the lever rod;

(d) whereby, after the trigger half-cylinder free edge and the pole half-cylinder free edge are pivoted together, the lever is pivoted toward the pole half-cylinder until the lever rod is within the pole half-cylinder notch and the paddle bearing surface is abutting the pole half-cylinder bearing surface, and the paddle free end is pushed inwardly to cause the cammed pole half-cylinder bearing surface to force the trigger half-cylinder free edge and the pole half-cylinder free edge together securely.

4. The trigger assembly of claim 3 wherein at least one of the lever rod cuff end attachment and the lever rod paddle end attachment includes a pin that rotates paraxially to the system axis and the rod is threaded to turn into a threaded hole in the pin.

5. The trigger assembly of claim 1 wherein the hub has an inner surface that is textured.

6. The trigger assembly of claim 1 wherein the hub has an inner surface and an insert attached to the inner surface.

7. A trigger assembly for a projectile launcher comprising:

(a) a cylindrical hub having a central system axis and an inner surface, the hub comprised of a trigger half-cylinder with a hinge edge and a free edge and a pole half-cylinder with a hinge edge and a free edge, the trigger half-cylinder hinge edge and the pole half-cylinder hinge edge being attached by a hinge to pivot paraxially with the system axis;

(b) an insert attached to the inner surface;

(c) an attachment mechanism for securing the trigger half-cylinder free edge and the pole half-cylinder free edge together;

(d) a trigger mechanism mounted in a trigger housing on the trigger half-cylinder, the trigger housing having an outer surface, the trigger mechanism comprising:

(1) an elongated trigger having a first end and a second end, an approximately 90° bend to a stem at the first end, the stem having a pivot end opposite the bend, the pivot end being mounted in the trigger housing to pivot perpendicularly to the system axis, the second end extending back and outwardly from the trigger housing;

(2) a release bar with a trigger end and a catch end, the release bar mounted to reciprocate paraxially with the system axis in a channel in the trigger housing, the trigger end mounted to pivot perpendicularly to the system axis at the trigger bend;

(3) a spring mounted to bias the release bar forwardly; and (4) a catch mounted in the trigger housing to pivot perpendicularly to the system axis and having an arm extending away from the pivot, the catch pivoting between a capture position wherein the arm extends outwardly and rearwardly and forming a notch with a hollow on the trigger housing outer surface, and a release position wherein the arm extends generally forwardly, the catch having a ledge such that, when in the capture position, the catch end of the release bar overhangs the ledge to prevent pivoting of the catch;

(e) latch mechanism comprising:

(1) a latch mounted in the trigger housing outside of the trigger to pivot perpendicularly to the system axis, the latch having a hook finger with a forward facing hook notch with an inside wall and latch release lever extending outwardly and rearwardly;

(2) a latch pin extending transversely through a slot in the trigger rearwardly of the stem bend; and (3) a spring biasing the latch in a latched position where the latch pin is in the hook notch, preventing the trigger from being pulled inwardly;

(f) whereby, when the latch release lever is pushed outwardly to an unlatched position, the latch pin is not in the hook notch and the trigger can be pulled inwardly, and when the trigger is pulled inwardly, the release bar is pulled rearwardly away from the catch ledge, permitting the catch to pivot forwardly.

8. The trigger assembly of claim 7 wherein the attachment mechanism comprises:

(a) a lever rod having a cuff end and a paddle end, the cuff end attached to the trigger half-cylinder free edge to pivot paraxially to the system axis;

(b) a paddle having a bearing end and free end, the paddle bearing end attached to the lever rod paddle end to pivot paraxially to the system axis, the paddle bearing end having an elongated, convex bearing surface extending paraxially to the system axis, the bearing surface shaped as an eccentric cam in cross-section; and (c) an elongated, concave bearing surface adjacent to the pole half-cylinder free edge, the concave bearing surface bisected by a notch aligned with the lever rod;

(d) whereby, after the trigger half-cylinder free edge and the pole half-cylinder free edge are pivoted together, the lever is pivoted toward the pole half-cylinder until the lever rod is within the pole half-cylinder notch and the paddle bearing surface is abutting the pole half-cylinder bearing surface, and the paddle free end is pushed inwardly to cause the cammed pole half-cylinder bearing surface to force the trigger half-cylinder free edge and the pole half-cylinder free edge together securely.

9. The trigger assembly of claim 8 wherein at least one of the lever rod cuff end attachment and the lever rod paddle end attachment includes a pin that rotates paraxially to the system axis and the rod is threaded to turn into a threaded hole in the pin.

* * * * *